US010488108B2

(12) United States Patent
Plavnik et al.

(10) Patent No.: US 10,488,108 B2
(45) Date of Patent: Nov. 26, 2019

(54) INDIRECT ACOUSTIC DRYING SYSTEM AND METHOD

(71) Applicant: Heat Technologies, Inc., Atlanta, GA (US)

(72) Inventors: Zinovy Zalman Plavnik, Atlanta, GA (US); Glenn Johnson Emory, Peachtree City, GA (US); Aliaksandr Hrynchuk, DeKalb, IL (US); Jason Lye, Atlanta, GA (US); Richard Terrell Sisk, Longville, GA (US); Leonid Anatolyevich Volozhanin, Marietta, GA (US)

(73) Assignee: Heat Technologies, Inc., Atlanta, GA (US)

( * ) Notice: Subject to any disclaimer, the term of this patent is extended or adjusted under 35 U.S.C. 154(b) by 331 days.

(21) Appl. No.: 14/321,354

(22) Filed: Jul. 1, 2014

(65) Prior Publication Data

US 2016/0003541 A1 Jan. 7, 2016

(51) Int. Cl.
*F26B 5/02* (2006.01)

(52) U.S. Cl.
CPC ..... *F26B 5/02* (2013.01)

(58) Field of Classification Search
CPC ..... F26B 5/02; F26B 13/007; F26B 13/102; B08B 7/028; B41P 2235/14; H05K 3/227; B05C 9/14; B05C 11/06
USPC ..... 118/58, 68
See application file for complete search history.

(56) References Cited

U.S. PATENT DOCUMENTS

| | | | | |
|---|---|---|---|---|
| 2,470,202 | A | 4/1956 | Fowle | |
| 2,972,196 | A | 2/1961 | Early et al. | |
| 3,186,329 | A * | 6/1965 | Kennedy | F24F 13/06 454/316 |
| 3,346,932 | A | 10/1967 | Cheape, Jr. | |
| 3,557,466 | A | 1/1971 | Bodine | |
| 3,668,785 | A | 6/1972 | Rodwin | |

(Continued)

FOREIGN PATENT DOCUMENTS

| | | |
|---|---|---|
| CA | 2748263 | 11/2014 |
| DE | 1031264 | 6/1958 |

(Continued)

OTHER PUBLICATIONS

"Drying." In Academic Press Dictionary of Science and Technology, edited by Christopher G. Morris. 4th ed. Elsevier Science & Technology, 1992. http://search.credoreference.com/content/entry/apdst/drying/0. Accessed May 2017.*

(Continued)

*Primary Examiner* — Jianying C Atkisson
*Assistant Examiner* — Tavia Sullens
(74) *Attorney, Agent, or Firm* — Taylor English Duma, LLP

(57) ABSTRACT

Disclosed is an acoustic head for indirectly drying a material, the acoustic head including at least one ultrasonic transducer facing the material, the material having a first side, and a second side, the second side opposite the first side, the second side defining a surface to be dried, the ultrasonic transducer positioned facing the first side; and an air delivery unit positioned facing the first side of the material.

26 Claims, 9 Drawing Sheets

(56) References Cited

U.S. PATENT DOCUMENTS

| | | | | |
|---|---|---|---|---|
| 3,694,926 | A | 10/1972 | Rodwin et al. | |
| 3,750,306 | A | 8/1973 | Rodwin et al. | |
| 4,178,188 | A | 12/1979 | Dussault et al. | |
| 4,302,623 | A | 11/1981 | Canfield | |
| 4,561,953 | A | 12/1985 | Muralidhara et al. | |
| 4,689,895 | A | 9/1987 | Taylor et al. | |
| 4,729,175 | A | 3/1988 | Beard et al. | |
| 4,763,424 | A | 8/1988 | Taylor et al. | |
| 4,876,803 | A | 10/1989 | Wedel | |
| 5,105,557 | A | 4/1992 | Vadasz | |
| 5,220,346 | A | 6/1993 | Carreira et al. | |
| 5,396,270 | A | 3/1995 | Gooray et al. | |
| 5,595,349 | A | 1/1997 | Bergstrom et al. | |
| 5,617,887 | A | 4/1997 | Shibano | |
| 5,630,420 | A | 5/1997 | Vaitekunas | |
| 5,631,685 | A | 5/1997 | Gooray et al. | |
| 6,085,437 | A | 7/2000 | Stipp | |
| 6,090,241 | A | 7/2000 | Trokhan et al. | |
| 6,176,184 | B1 | 1/2001 | Mudry | |
| 6,203,151 | B1 | 3/2001 | Ruhe | |
| 6,210,149 | B1 | 4/2001 | Plavnik | |
| 6,376,145 | B1 | 4/2002 | Meyer | |
| 6,393,719 | B1 * | 5/2002 | Stipp | F26B 23/026 34/114 |
| 6,431,702 | B2 * | 8/2002 | Ruhe | B41J 2/01 347/102 |
| 6,503,580 | B1 | 1/2003 | Ruffa | |
| 6,662,812 | B1 | 12/2003 | Hertz et al. | |
| 6,742,285 | B2 | 6/2004 | Shepard | |
| 6,754,980 | B2 | 6/2004 | Lauerhaas | |
| 6,931,205 | B2 | 8/2005 | Atkins | |
| 7,293,567 | B2 | 11/2007 | Hertz et al. | |
| 7,497,301 | B2 | 3/2009 | Cheng et al. | |
| 8,105,526 | B2 | 1/2012 | Stone et al. | |
| 8,756,825 | B2 | 6/2014 | Priebe | |
| 8,943,706 | B2 | 2/2015 | Bucks | |
| 9,068,775 | B2 | 6/2015 | Plavnik | |
| 9,140,494 | B2 | 9/2015 | Bucks et al. | |
| 9,163,875 | B2 | 10/2015 | Bucks | |
| 9,671,166 | B2 | 6/2017 | Plavnik et al. | |
| 10,006,704 | B2 | 6/2018 | Plavnik | |
| 10,139,162 | B2 | 11/2018 | Plavnik et al. | |
| 2003/0184630 | A1 | 10/2003 | Elgee | |
| 2004/0011133 | A1 | 1/2004 | Busch et al. | |
| 2004/0124230 | A1 | 7/2004 | Hertz et al. | |
| 2005/0211387 | A1 * | 9/2005 | Suzuki | F26B 13/12 156/382 |
| 2007/0128368 | A1 | 6/2007 | Minamino et al. | |
| 2007/0169371 | A1 | 7/2007 | Feng et al. | |
| 2007/0169800 | A1 | 7/2007 | Fani et al. | |
| 2008/0301971 | A1 | 12/2008 | Koretsky | |
| 2009/0007931 | A1 | 1/2009 | Krebs et al. | |
| 2009/0300939 | A1 | 12/2009 | Kennedy et al. | |
| 2010/0071194 | A1 | 3/2010 | Derrick et al. | |
| 2010/0199510 | A1 | 8/2010 | Plavnik | |
| 2011/0131829 | A1 * | 6/2011 | Zagar | F26B 13/104 34/274 |
| 2014/0150285 | A1 * | 6/2014 | Bucks | F26B 5/02 34/279 |
| 2014/0152749 | A1 | 6/2014 | Shifley | |
| 2014/0202021 | A1 | 7/2014 | Bucks | |
| 2014/0202024 | A1 | 7/2014 | Bucks et al. | |
| 2015/0233637 | A1 | 8/2015 | Plavnik | |
| 2015/0239021 | A1 * | 8/2015 | Ponomarev | B08B 3/12 134/1 |
| 2016/0003541 | A1 | 1/2016 | Plavnik | |
| 2016/0025411 | A1 | 1/2016 | Plavnik | |
| 2017/0219284 | A1 | 8/2017 | Plavnik | |
| 2018/0363980 | A1 | 12/2018 | Plavnik | |

FOREIGN PATENT DOCUMENTS

| | | |
|---|---|---|
| DE | 2053284 | 5/1971 |
| EP | 2394121 | 3/2019 |
| JP | H05133683 | 5/1993 |
| JP | 06026764 | 2/1994 |
| JP | H0626764 | 2/1994 |
| JP | H0755339 | 3/1995 |
| JP | 2000258055 | 9/2000 |
| KR | 101273231 | 6/2013 |
| WO | 09805580 | 2/1998 |
| WO | 0001883 | 1/2000 |
| WO | 0019007 | 4/2000 |
| WO | 0196115 | 12/2001 |
| WO | 2006042559 | 4/2006 |
| WO | 2009057054 | 5/2009 |
| WO | 2010090690 | 12/2010 |
| WO | 2013182654 | 12/2013 |
| WO | 2014048431 | 4/2014 |
| WO | 2014113318 | 7/2014 |
| WO | 2016014960 | 1/2016 |

OTHER PUBLICATIONS

Bosch Packaging North America: "Top 10 packaging materials (films) used on horizontal flow wrappers". Jun. 28, 2013. Accessed Sep. 2017.*

Plavnik, Zinovy; Advisory Action for U.S. Appl. No. 12/367,803, filed Feb. 9, 2009, dated Nov. 20, 2012, 6 pgs.

Plavnik, Zinovy; Applicant Initiated Interview Summary for U.S. Appl. No. 12/367,803, filed Feb. 9, 2009, dated Jan. 28, 2014, 3 pgs.

Plavnik, Zinovy; Applicant Initiated Interview Summary for U.S. Appl. No. 12/367,803, filed Feb. 9, 2009, dated Jul. 2, 2014, 3 pgs.

Plavnik, Zinovy; Final Office Action for U.S. Appl. No. 12/367,803, filed Feb. 9, 2009, dated Dec. 2, 2013, 12 pgs.

Plavnik, Zinovy; Final Office Action for U.S. Appl. No. 12/367,803, filed Feb. 9, 2009, dated Jul. 30, 2012, 21 pgs.

Plavnik, Zinovy; Non-Final Office Action for U.S. Appl. No. 12/367,803, filed Feb. 9, 2009, dated Jan. 31, 2012, 21 pgs.

Plavnik, Zinovy; Non-Final Office Action for U.S. Appl. No. 12/367,803, filed Feb. 9, 2009, dated May 1, 2014, 22 pgs.

Plavnik, Zinovy; Non-Final Office Action for U.S. Appl. No. 12/367,803, filed Feb. 9, 2009, dated Apr. 8, 2013, 20 pgs.

Plavnik, Zinovy; Restriction Requirement for U.S. Appl. No. 12/367,803, filed Feb. 9, 2009, dated Oct. 24, 2011, 7 pgs.

Plavnik, Zinovy; U.S. Patent Application entitled: Ultrasonic Drying System and Method, having U.S. Appl. No. 12/367,803, filed Feb. 9, 2009, 60 pgs.

Plavnik, Zinovy; International Preliminary Report on Patentability for PCT/US2009/069395, filed Dec. 23, 2009, dated Aug. 9, 2011, 12 pgs.

Plavnik, Zinovy; International Search Report and Written Opinion for PCT/US2009/069395, filed Dec. 23, 2009, dated Mar. 23, 2010, 13 pgs.

Plavnik, Zinovy; Canadian Office Action for serial No. 2,748,263, filed Dec. 23, 2009, dated Apr. 16, 2013, 4 pgs.

Kelva; Web Cleaner-Web cleaner head BR41/Filter-and fan unit K-22; internet article—www.kelva.com No date available; 4 pgs; Lund, Sweden.

Web Systems Inc.; Ultra Web Cleaner internet article—www.wsinfo.com/index.html; Printed Dec. 7, 2008; 6 pgs.

Plavnik, Zinovy; Final Office Action for U.S. Appl. No. 12/367,803, filed Feb. 9, 2009, dated Nov. 18, 2014, 21 pgs.

Plavnik, Zinovy; Notice of Allowance for U.S. Appl. No. 12/367,803, filed Feb. 9, 2009, dated Feb. 5, 2015, 11 pgs.

English translation of German Patent No. 1031264, filed Jun. 4, 1958. 3 pgs (previously-cited DE 1031264 provided for translation purposes only).

Plavnik, Zinovy; Issue Notification for U.S. Appl. No. 12/367,803, filed Feb. 9, 2009, dated Jun. 10, 2015, 1 pg.

Plavnik, Zinovy; Notice of Allowance for U.S. Appl. No. 12/367,803, filed Feb. 9, 2009, dated May 18, 2015, 13 pgs.

"PCB Basics" by Sfuptownmaker . . . Jan. 12, 2013. Sparkfun. [retrieved from the internet] [retrieved on Aug. 15, 2015]. <URL:https://learn.sparkfun.com/tutorials/pcb-basics> ; p. 4, figure 1, paragraph 1 and 2, 13 pgs.

(56) References Cited

OTHER PUBLICATIONS

Plavnik, Zinovy; U.S. Continuation Application entitled: Ultrasonic Drying System and Method having U.S. Appl. No. 14/698,104, filed Apr. 28, 2015, 52 pgs.
Plavnik, Zinovy; U.S. Patent Application entitled: Acoustic-Assisted Heat and Mass Transfer Device having U.S. Appl. No. 14/808,625, filed Jul. 24, 2015, 72 pgs.
Plavnik, Zinovy; International Search Report and Written Opinion for PCT Application No. PCT/US15/34440, filed Jun. 5, 2015, dated Sep. 14, 2015, 9 pgs.
Plavnik, Zinovy; PCT Application entitled: Indirect Acoustic Drying System and Method having serial No. PCT/US15/34440, filed Jun. 5, 2015, 38 pgs.
Plavnik, Zinovy; PCT Application entitled: Acoustic-Assisted Heat and Mass Transfer Device having serial No. PCT/US15/42028, field Jul. 24, 2015, 71 pgs.
Plavnik, Zinovy; U.S. Provisional Patent Application entitled: Acoustic-Assisted Heat and Mass Transfer Device, U.S. Appl. No. 62/028,656, filed Jul. 24, 2014; 21 pgs.
Plavnik, Zinovy; International Search Report and Written Opinion for serial No. PCT/US15/42028, filed Jul. 24, 2015, dated Oct. 23, 2015, 8 pgs.
Incropera, et al.; "The Effects of Turbulence", Fundamentals of Heat and Mass Transfer, 1996, 7 pgs.
Kelva; Web Cleaner—Web cleaner head BR41/Filter and fan unit K-22; internet article—www.kelva.com; document available prior to Feb. 9, 2008; Lund, Sweden; 4 pgs.
Kohler, Herbert B.; "Modern Rod Coaters", available at www.kohlercoating.com/reference/refpdfs/HBKrodcoater.PDF, publicly available prior to Feb. 9, 2008, 7 pgs.
Morin, David; "Chapter 7—2D Waves and other topics", available at http://www.people.fas.harvard.edu/~djmorin/book.html, publicly available prior to Jul. 1, 2013, 11 pgs.
Wikipedia; Article entitled "Coating", located at http://en.wikipedia.org/wiki/Coating, accessed on Apr. 25, 2014, 5 pgs.
Wikipedia; Article entitled "Mersenne's Law", located at http://en.wikipedia.org/wiki/Mersenne%27s_Laws, accessed on May 2, 2014, 2 pgs.
Plavnik, Zinovy; Notice of Allowance for U.S. Appl. No. 14/808,625, filed Jul. 24, 2015, dated Jan. 13, 2017, 7 pgs.
Plavnik, Zinovy Zalman: International Preliminary Report on Patentability for PCT/US15/034440, filed Jun. 5, 2015, dated Jan. 12, 2017, 8 pgs.
Plavnik, Zinovy; International Preliminary Report on Patentability for Serial No. PCT/US15/42028, filed Jul. 24, 2015, dated Feb. 2, 2017, 6 pgs.
Plavnik, Zinovy; Updated Notice of Allowance for U.S. Appl. No. 14/808,625, filed Jul. 24, 2015, dated Feb. 22, 2017, 19 pgs.
Busnaina, et al.; Article entitled: "Ultrasonic and Megasonic Particle Removal", Precision Cleaning '95 Proceedings, cited in the Non-Final Office Action for U.S. Appl. No. 14/808,625 dated Sep. 22, 2016, 14 pgs.
Plavnik, Zinovy Zalman; Applicant Interview Summary for U.S. Appl. No. 14/808,625, filed Jul. 24, 2015, dated Nov. 10, 2016, 3 pgs.
Plavnik, Zinovy Zalman; Non-Final Office Action for U.S. Appl. No. 14/808,625, filed Jul. 24, 2015, dated Sep. 22, 2016, 18 pgs.
Plavnik, Zinovy; Extended European Search Report for serial No. 09839835.7, filed Dec. 23, 2009, dated Oct. 26, 2016, 14 pgs.
Plavnik, Zinovy Zalman; Non-Final Office Action for U.S. Appl. No. 14/698,104, filed Apr. 28, 2015, dated May 24, 2017, 48 pgs.
Plavnik, Zinovy; Issue Notification for U.S. Appl. No. 14/808,625, filed Jul. 24, 2015, dated May 17, 2017, 1 page.
Plavnik, Zinovy; Applicant Initiated Interview Summary for U.S. Appl. No. 14/698,104, filed Apr. 28, 2017, dated Aug. 24, 2017, 3 pages.
Plavnik, Zinovy; Notice of Allowance for U.S. Appl. No. 14/698,104, filed Apr. 28, 2015, dated Nov. 30, 2017, 17 pgs.
Plavnik, Zinovy Zalman; Extended European Search Report for serial No. 15815936.8, filed Jun. 5, 2015, dated Jan. 2, 2018, 9 pgs.
Plavnik, Zinovy Zalman; Extended European Search Report for serial No. 15824606.6, filed Jul. 24, 2015, dated Jan. 16, 2018, 8 pgs.
Plavnik, Zinovy; Corrected Notice of Allowance for U.S. Appl. No. 14/698,104, filed Apr. 28, 2015, dated Feb. 27, 2018, 6 pgs.
Plavnik, Zinovy Zalman; Non-Final Office Action for U.S. Appl. No. 15/486,469, filed Apr. 13, 2017, dated Feb. 26, 2018, 25 pgs.
Zinovy, Plavnik; Issue Notification for U.S. Appl. No. 14/698,104, filed Apr. 28, 2015, dated Jun. 6, 2018, 1 pg.
Plavnik, Zinovy Zalman; Applicant-Initiated Interview Summary for U.S. Appl. No. 15/486,469, filed Apr. 13, 2017, dated May 17, 2018, 5 pgs.
Plavnik, Zinovy Zalman; Notice of Allowance for U.S. Appl. No. 15/486,469, filed Apr. 13, 2017, dated Jul. 13, 2018, 5 pgs.
Plavnik, Zinovy; Office Action for European application No. 09839835.7, filed Dec. 23, 2009, dated Jun. 19, 2018, 4 pgs.
Plavnik, Zinovy Zalman; Issue Notification for U.S. Appl. No. 15/486,469, filed Apr. 13, 2017, dated Nov. 7, 2018, 1 pg.
Plavnik, Zinovy Zalman; Supplemental Notice of Allowance for U.S. Appl. No. 15/486,469, filed Jan. 13, 2017, dated Oct. 23, 2018, 4 pgs.
Plavnik, Zinovy Zalman; Supplemental Notice of Allowance for U.S. Appl. No. 15/486,469, filed Apr. 13, 2017, dated Sep. 6, 2018, 6 pgs.
Plavnik, Zinovy Zalman; European Search Report for serial No. 15815936.8, filed Jun. 5, 2015, dated Oct. 18, 2018, 7 pgs.
Plavnik, Zinovy Zalman; Office Action for Japanese application No. 521055/2017, filed Jun. 5, 215, dated Oct. 2, 2018, 9 pgs.
Plavnik, Zinovy Zalman; Examination Report for European serial No. 15824606.6, filed Jul. 24, 2015, dated Jan. 21, 2019, 5 pgs.
Plavnik, Zinovy Zalman; European Search Report for serial No. 15815936.8, filed Jun. 5, 2015, dated Apr. 9, 2019, 5 pgs.
Plavnik, Zinovy Zalman; Extended European Search Report for serial No. 19163899.8, filed Dec. 23, 2009, dated Aug. 23, 2019, 8 pgs.
Plavnik, Zinovy Zalman; European Search Report for serial No. 15815936.8, filed Jun. 5, 2015, dated Aug. 26, 2019, 5 pgs.
Plavnik, Zinovy Zalman; Office Action for Japanese application No. 521055/2017, filed Jun. 5, 215, dated Aug. 6, 2019, 9 pgs.

* cited by examiner

INDIRECT ACOUSTIC DRYING SYSTEM AND METHOD

TECHNICAL FIELD

The present invention relates generally to heating and drying technologies and, in particular, to heating and drying with the assistance of ultrasound.

BACKGROUND

It has been observed that the majority of energy intensive processes are driven by the rates of the heat and mass transfer. Specific details of a particular application, such as the chemistry involved in drying a material or applying a coating to a substrate (e.g., a factor in label printing, sheet-fed and continuous printing, converting, packaging, and mass mailing), the temperature and specific properties of both the substrate and the coating including the thickness of both the substrate and coating, the method of application, the residence time for a particular coating to dry, the ambient conditions, and the resulting water or solvent evaporation rates are factors in the outcome of any drying and/or heating process. These factors often dictate the nature and size of the drying equipment.

The properties of the boundary layer formed next to the surface along which a fluid moves dictate the heat transfer rate at the surface and therefore the drying rate for the aforementioned application of coating a substrate and for the more general application of drying materials without a coating. As a consequence of the effect of the boundary layer on the heat transfer rate, it can be argued—as Incropera/DeWitt do in their textbook "Fundamentals of Heat and Mass Transfer"—that heat transfer rates are higher for turbulent flow at a surface than for laminar flow at that surface. In modern heating and drying practice, there are several methods to disrupt the boundary layer in order to produce more turbulent flow and therefore more heat transfer.

One method of disrupting the boundary layer, in order to increase the heat transfer rate or for any other purpose, and therefore the drying rate of a wet surface, is to focus acoustic sound waves or oscillations—ultrasonic waves or oscillations, for example—and optionally heated air at the surface of the material or coating being dried as shown in U.S. Patent Publication No. 2010-0199510, published Dec. 12, 2010, which is hereby incorporated by reference in its entirety.

In some applications where acoustic sound waves—ultrasonic waves, for example—or heat, radiant or otherwise, or forced air or a combination of these elements are directed towards the coating to be dried and at the same time facing the coating itself, especially in applications where the coating is relatively thick, the surface can be damaged either before or after the drying process or can be otherwise undesirably impacted by this process. The surface of the coating and/or substrate can develop cracks or form a surface skin, which then impedes the exit of moisture or solvent deeper in the coating, and this could affect the performance of the coating or substrate or the material as a whole. In some cases, the process itself will be slowed considerably in order to avoid even some of the undesirable effects. When drying a coating on a solid substrate using an air stream as stated above, however, the air is nonetheless typically directed towards the wet surface to be dried.

SUMMARY

Disclosed is an acoustic head for indirectly drying a material, the acoustic head including at least one ultrasonic transducer facing the material, the material having a first side, and a second side, the second side opposite the first side, the second side defining a surface to be dried, the ultrasonic transducer positioned facing the first side; and an air delivery unit positioned facing the first side of the material.

Also disclosed is a system for indirectly drying a material, the system including a material, the material having a substrate, a coating to be dried, a first side, and a second side, the second side opposite the first side, the coating to be dried at least partially covering the second side; an acoustic head, the acoustic head including at least one ultrasonic transducer facing the first side of the material; and an air delivery unit, the air delivery unit also positioned facing the first side of the material.

Also disclosed is a method of indirectly drying a material, the method including applying a coating to be dried to a substrate to form a material, the material having a first side, and a second side, the second side opposite the first side, the coating to be dried at least partially covering the second side, an acoustic head and an air delivery unit positioned facing the first side of the material; moving the material in a transverse direction relative to an acoustic head and air delivery unit, the acoustic head including at least one ultrasonic transducer, the ultrasonic transducer positioned facing the first side of the material, the air delivery unit also positioned facing the first side of the material; and drying the material using acoustic waves generated by the at least one ultrasonic transducer.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
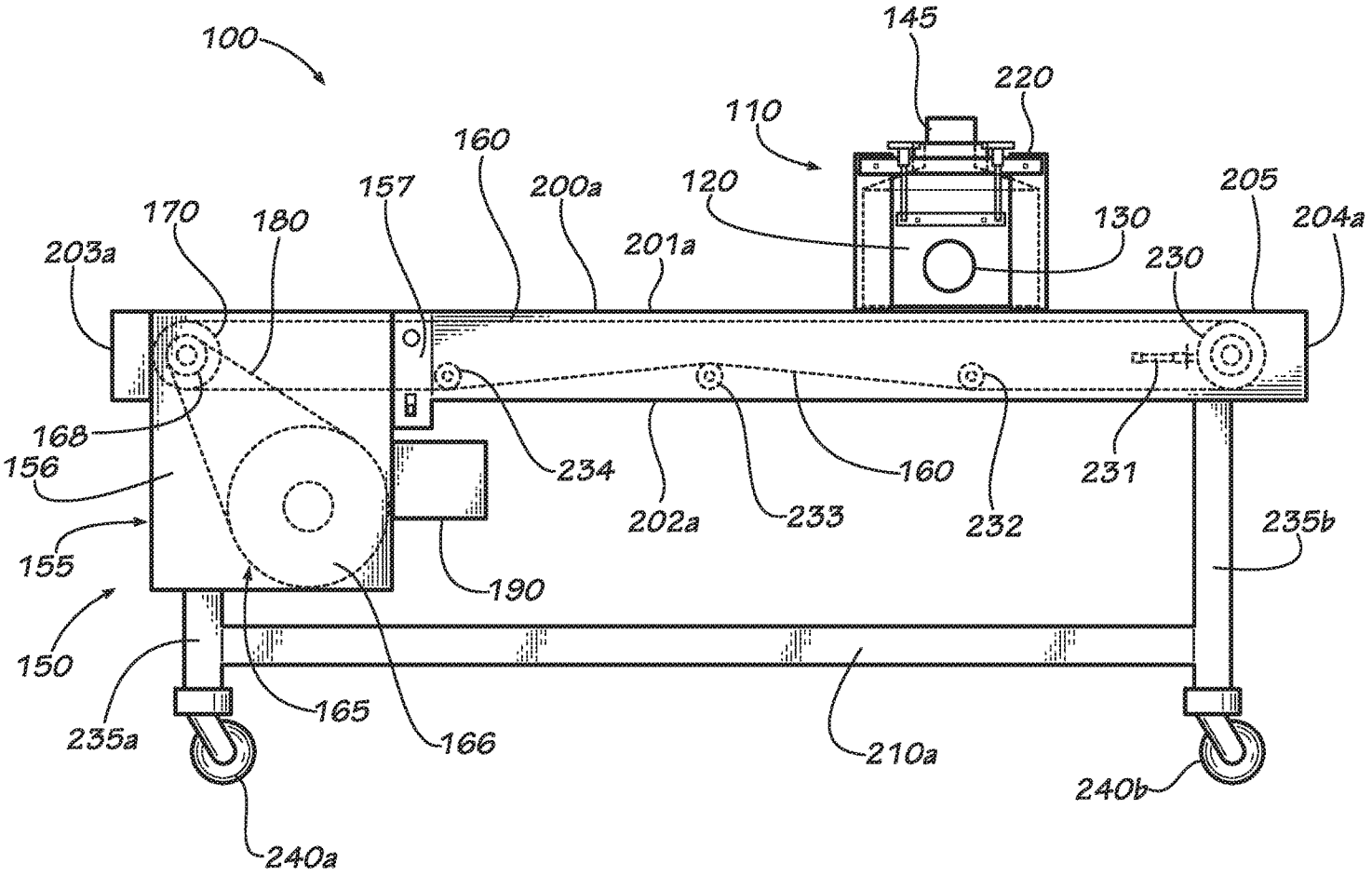
FIG. 1 is a side view of one embodiment of a system for indirectly drying a material.

Disclosed is an acoustic drying system and associated methods, systems, devices, and various apparatus. It would be understood by one of skill in the art that the disclosed system is described in but a few exemplary embodiments among many. No particular terminology or description should be considered limiting on the disclosure or the scope of any claims issuing therefrom.

A partial list of potential uses of the disclosed technology includes but is not limited to printing, residential and commercial cooking appliances, food processing equipment, textiles, carpets, converting industries, fabric dyeing, and so on. In particular, the disclosed system(s) and method(s) can be configured for flexographic and gravure printing of wallpaper, gift-wrap paper, corrugated containers, folding cartons, paper sacks, plastic bags, milk and beverage cartons, candy and food wrappers, disposable cups, labels, adhesives, envelopes, newspapers, magazines, greeting cards, and advertising pieces. Further potential uses of the disclosed technology are paper-making and the painting of motorized vehicles and their components. The disclosed can be adapted for these and many other batch and continuous heating and drying processes.

The adhesives for which various embodiments of the presently disclosed structure and methods would apply include various types of pressure-sensitive adhesives such as those adhesives used as or used as part of sticky tape, duct tape, adhesive fasteners, removable adhesive fasteners such as those used in sticky notes, adhesive wound care device adhesives such as used in BAND-AID bandaging products, adhesives used to hold absorbent pads to garments, self adhesive sheets used to hold solid objects, and cold seal adhesives for food packaging and mailing enclosures.

Also applicable to the presently disclosed structure and methods are various types of coatings and lacquers for films, various foils, and various metal and glass or ceramic sheets, including those having either decorative or functional coatings. In various embodiments, these coatings will be reflective, thermal insulating, electrical insulating, radio frequency absorbing, or mechanical shock absorbing, or these coatings may share several of these characteristics in combination. In various embodiments, the presently-disclosed structure and methods will also cover laminating materials for bonding sheets of various materials together to form composites, such as those used materials or composites used in glass windshields, in aerospace components such as wings, and in other applications such as the aforementioned painting of motorized vehicles and their components. In addition, in various embodiments, a water-based ultraviolet (UV) curable coating is typically dried prior to curing using UV light.

Use of the disclosed structure and methods can also be applied to drying films cast from polymer solutions. In such an application, a polymer solution is poured into a metal tray or onto a carrier sheet, and the solvent is evaporated to produce a dry film. Examples of such polymer-solvent systems include those in the following list:

carboxymethyl cellulose-water
hydroxypropylcellulose-water
2-hydroxyethylcellulose-water
cellulose acetate-acetone
ethyl cellulose-tetrahydrofuran
poly(vinyl alcohol) (~96% hydrolyzed)-water
poly(acrylic acid)-water
poly(vinyl pyrrolidone)-water
poly(styrene)-acetone
poly(methyl methacrylate)-acetone
poly(styrene-acrylic acid) block copolymer-water
poly(styrene-butadiene) block copolymer-xylene Use of the disclosed structure and methods can also be applied to polymer dispersions and cast films. A polymer dispersion is a film-forming polymer, and such a polymer is often converted to a film by a process of evaporation from a continuous liquid. For example, natural rubber latex, poly(vinyl acetate), or poly(urethane) dispersed in water may be dried to leave a film. As either water or the continuous liquid medium are removed through evaporation, the spheres of polymer coalesce to form a film. A plasticizer may be added to further facilitate coalescence of the polymer spheres from the polymer dispersion into a cohesive film. During the film casting process, the solvent (or continuous phase if the polymer is in the form of a dispersion) is evaporated by indirect application of the acoustic air to leave a polymer film. The acoustic energy is conducted through the carrier medium to enhance thermal and mass transfer at the interface between the coating and the surrounding gaseous medium, which is often air.

Examples of such films cast from solutions or dispersions may include edible films, including drug delivery devices, such as TRIAMINIC THIN STRIPS medicine strips, previously available from Novartis, New Jersey, and GAS-X THIN STRIPS medicine strips, currently available from Novartis, New Jersey. Other examples of cast films include water-soluble plastic bags and water-soluble packages containing detergents, dyes, or surfactants or a combination of these elements for use with the operation of dishwashers, clothes washing machines, and dying machines.

Because a wide range of products and processes beyond the specific processes, products, systems, or examples provided herein could be made possible or improved by that which is presently disclosed, none of the processes, products, systems, or examples described herein should be considered as limiting the disclosure.

As suggested previously and explained in further detail below, the formation of skin on a coating or material to be dried is often particularly problematic. Not only can it lead to the formation of microscopic or macroscopic surface cracks, but a surface-skinned coating is often very difficult to dry. Without a surface skin, solvent or water molecules can more easily diffuse up through the liquid bulk of the coating to the surface and then leave into the surrounding air. Once a skin forms on the surface of the coating, in various embodiments the water or solvent molecules now must diffuse through the solid skin before these molecules can leave the coating. This process of diffusion through a coating skin is a much slower process than the process of diffusion through a liquid coating, and it is common for some residual solvent or moisture to remain in the lower layers of the coating when a skin forms on the surface of a coating before drying of that coating is complete. This residual moisture or solvent has the potential to deleteriously affect the properties of the coating. For instance, residual moisture or solvent trapped beneath a surface skinned layer has the potential to form a blister, a bubble, or a crack during the remaining drying process. If the film is later warmed, blisters, bubbles, or cracks have the potential to develop. Trapped residual moisture or solvent has the potential to lead to corrosion if the coating is on a metal surface. The residual solvent or water may cause the coating to have an odor.

Applying heat to the side of a substrate opposite to the side that was coated can also lead to bubble or blister formation as well as the formation of a solid skin, sometimes referred to as "skinning". Applying or directing non-acoustic energized air to the side of a substrate opposite to the side that is coated often has little or no effect on accelerating the drying of the coating, as the forced air is unable to interact with the coating on the other side of the substrate.

Figure 2:
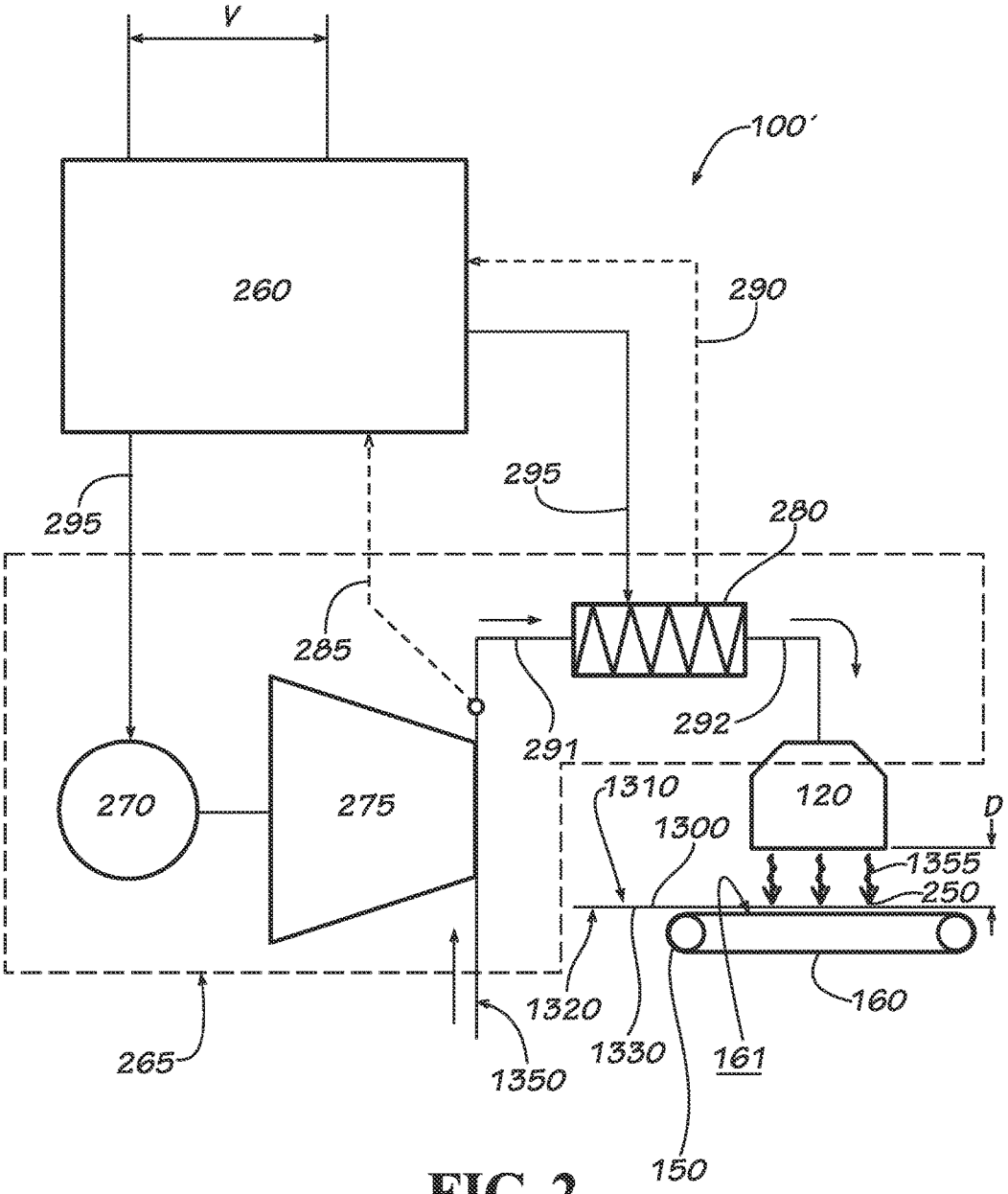
FIG. 2 is a schematic view of the system of FIG. 1 with a heater included.

Disclosed in FIG. 1 is a side view of one embodiment of an acoustic drying system 100 for indirectly drying a material 1300 (shown in FIG. 2). Acoustic drying system 100 includes a dryer assembly 110 and a material delivery unit 150. Dryer assembly 110 includes an acoustic head 120 and a support and positioning mechanism 220. Acoustic head 120 includes a delivery air inlet 130 positioned at one end of acoustic head 120 and a return air outlet 145 positioned at the top of acoustic head 120. In the current embodiment, delivery air inlet 130 is connected to an air supply system (shown in FIG. 3) and return air outlet 145 is connected to an air return system (shown in FIG. 3). In various embodiments, support and positioning mechanism 220 supports the entire acoustic head 120 although only one end of support and positioning mechanism 220 is shown in FIG. 1.

Material delivery unit 150 includes conveyor side frames including a conveyor side frame 200*a*, a set of two lower side frames including a lower side frame 210*a*, a set of four leg frames including leg frames 235*a,b*, a set of four caster assemblies including caster assemblies 240*a,b*, one positioned at the lower distal end of each leg frame. Also disclosed are a conveyor frame 205, a drive and control module 155, and a conveyor belt 160. Each conveyor side frame includes an upper end, a lower end, a first distal end, and a second distal end. Accordingly, conveyor side frame 200*a* includes an upper end 201*a*, a lower end 202*a*, a first distal end 203*a*, and a second distal end 204*a*.

Drive and control module 155 includes a drive module frame 156, a controller 157, a motor 190, and a drive train 165. Drive train 165, located proximate the first distal end 203*a* of conveyor side frame 200*a*, includes a drive pulley 166, a drive belt 180, a driven pulley 168, and a conveyor pulley 170. Drive train 165 also includes a drive pulley axle (not shown) and driven pulley axle (not shown). Drive pulley 166 is connected to, supported by, and rotating about the drive pulley axle. Driven pulley 168 and conveyor pulley 170 are connected to, supported by, and rotating about the driven pulley axle. Drive pulley 166, driven pulley 168, and conveyor pulley 170 can be grooved or smooth or contain teeth like a gear to interface with drive belt 180. The pulleys can be made out metal, plastic, or any other material having the required properties. Drive belt 180 can be a belt, a chain, or any other flexible linkage made out rubber, metal, plastic, or any other material having the required properties. The selection of motor 190 and the diameter of each pulley is made based on the desired conveyor speed of a conveyor belt 160. The conveyor speed at which various drying operations were performed was in the range of five feet per minute to 250 feet per minute, but other speeds are used in various embodiments. In order to cause movement of conveyor belt 160 past acoustic head 120, conveyor belt 160 is driven by conveyor pulley 170 and passes around a tension pulley 230, the horizontal location of which, relative to conveyor pulley 170, is adjustable by a pulley adjustment mechanism 231.

Conveyor belt 160 passes around not only conveyor pulley 170 and tension pulley 230 but also around auxiliary pulleys 232, 233, and 234. Auxiliary pulleys 232, 233, and 234 help maintain the position and tautness of conveyor belt 160. In various embodiments, material delivery unit 150 includes a conveyor system 159 and conveyor system 159 includes a conveyor belt 160 which transports the material 1300 past the acoustic head 120 to facilitate drying, although in various embodiments the acoustic head 120 will be made to move past a stationary material 1300 that is to be dried, or both the material 1300 and acoustic head 120 will be made to move during some or all of the drying process. In various other embodiments, conveyor system 159 will not include conveyor belt 160 and the presence of conveyor belt 160 should not be considered limiting. In various embodiments, conveyor system 159 will not require a conveyor belt 160 to transport or convey material 1300 past the acoustic head 120.

In various embodiments, a separation distance D between the acoustic head 120 and the conveyor belt 160 (shown in FIG. 2) is selected to optimize the effect of acoustic waves 250—ultrasonic waves in various embodiments—during the drying process. This separation distance D is approximately equal to the distance between the exit of an ultrasonic transducer 1000 (shown in FIG. 4) and the surface of the material or coating being dried and in various embodiments will be between 4 mm and 100 mm, though other separation distances may be used in various embodiments.

In the embodiment of FIG. 1 and various other embodiments, support and positioning mechanism 220 adjustably supports acoustic head 120 of dryer assembly 110 above conveyor belt 160. Support and positioning mechanism 220 can be made from separately fabricated components as shown in the current embodiment of acoustic drying system 100, or support and positioning mechanism 220 can be fabricated from a single component. The current embodiment of support and positioning mechanism 220 is attached to upper end 201*a* of conveyor side frame 200*a* and an upper end of a conveyor side frame that is distal to the conveyor side frame 200*a* at a position that is between conveyor pulley 170 and tension pulley 230. Support and positioning mechanism 220 is configured to allow adjustment of the separation distance between acoustic head 120 and conveyor belt 160.

Figure 3:
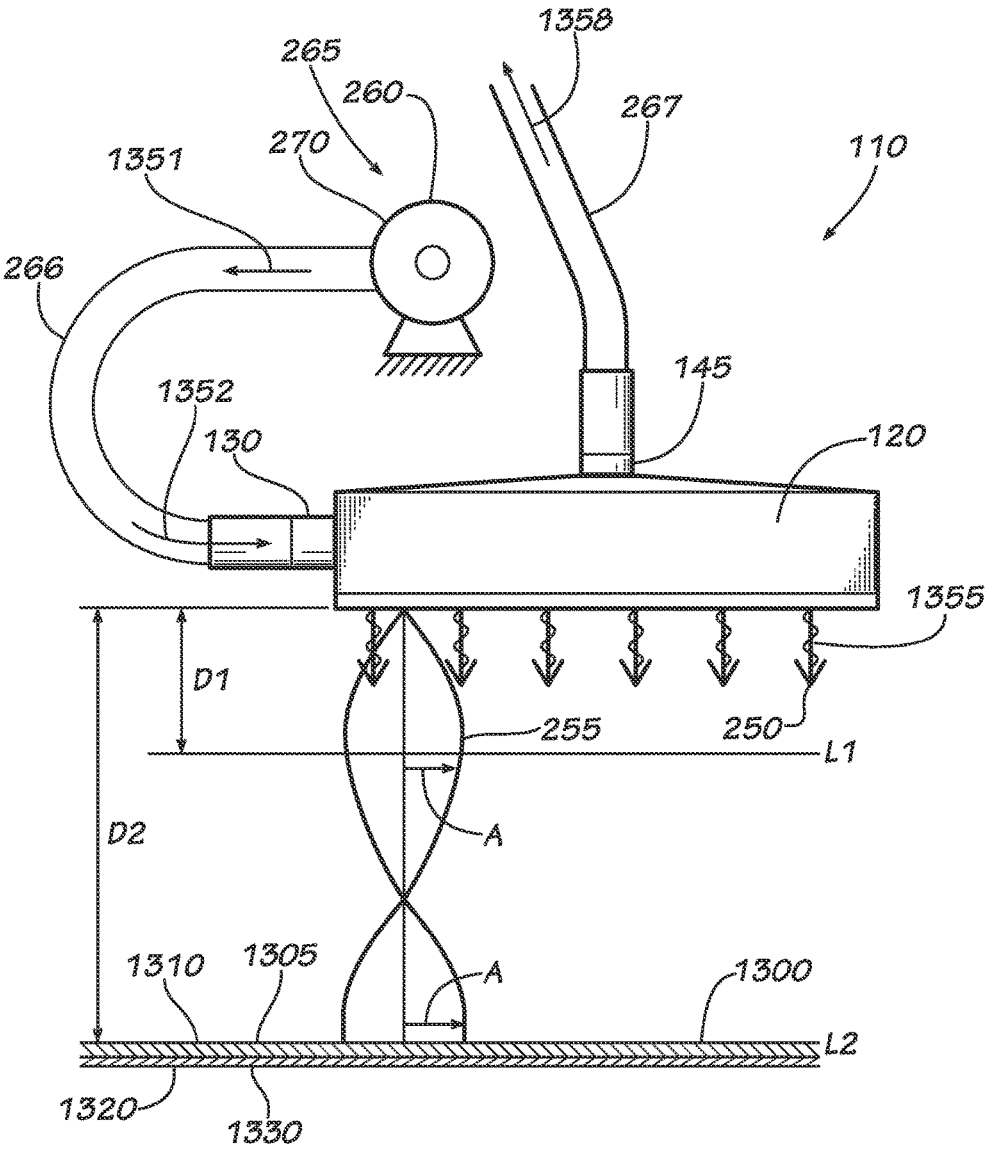
FIG. 3 is a side view of one embodiment of a dryer assembly of the system of FIG. 1 with connecting air duct and motor elements.

In various embodiments, the material 1300 to be dried includes a first side 1310 and a second side 1320, and at least two different components—a substrate 1305 (shown in FIG. 3) and a coating 1330 (shown in FIG. 3). Coating 1330 will be either partially or completely covering the second side 1320 of the material 1300. As shown, the coating 1330 can be applied to only the second side 1320 of the material 1300. Applying coating 1330 only to a portion of the second side 1320 of material 1300 may be desired in various embodiments where a specific pattern is desired that does not completely cover the second side 1320. In various embodiments, this pattern includes graphics containing one or more colors with or without text in one or more languages.

In various embodiments, substrate 1305 of material 1300 will include any one or more of a number of materials to which a coating can physically be applied. In various embodiments, material 1300 will only include substrate 1305 and will not include a coating 1330 but will nevertheless require drying on one or both sides. The group of materials from which substrate 1305 can be made includes but is not limited to sheet metal, foil, polyethylene terephthalate (PET), polypropylene (PP), polyvinylidene chloride (PVDC), polyvinyl chloride (PVC), and polyvinyl butyral (PVB). In various embodiments, the material used will be described as a film. In various other embodiments, the material will not be described as a film. In various embodiments, the substrate 1305 will have a thickness in the range of 10 microns to 2,000 microns (0.010 mm to 2 mm), but in various embodiments the thickness will not be in the range of 10 microns to 2,000 microns and the disclosure of a substrate 1305 having a thickness of 10 microns to 2,000 microns should not be considered limiting on the present disclosure.

In various other embodiments, a coating will also be on the first side 1310 of the material. In other words, it may be beneficial to dry one coating on the second side 1320 and another coating on the first side 1310, and either coating or both coatings could be dried using equipment facing the side facing opposite that side being dried. This drying of both sides could be made to take place at the same time and the same place on the material linearly, or it could be made to take place at different times or at different locations on the same material delivery system.

In various other embodiments, the coating may be absent from both sides and the material without coating, which could be a composition of two or more different materials, is therefore exposed on both the first side 1310 and the second side 1320, at least at the point in time when drying is to take place. In these instances, it is only the substrate 1305 that requires drying. In various embodiments, the material will be made wet on only one side—during a cleaning process, for example—and benefit from a subsequent drying operation. Because of the properties of that particular material or composite of materials in various embodiments, it will not be wet throughout the material. In various embodiments, it will either have a skin on the first side that partially or completely interferes with drying or that makes it less desirable to dry with equipment facing the first side of the material. In various embodiments, the material will be a composite of heterogeneous materials without any coatings that will nonetheless benefit from indirect drying by one or more of the processes disclosed herein. While not to be considered limiting, various embodiments of this disclosure include the cleaning or dying of carpet or fabric. In the case of a material that has been cleaned, it is desirable in some embodiments to remove moisture on the second side of the material using equipment facing the first side. In the case of material that has been treated with a chemical and not a coating, it will be beneficial in some embodiments to remove traces of the chemical or reduce the amount of chemical in the material but using equipment facing the first side of the material that will remove this chemical partially or completely from the second side of the material. This chemical will be water-based in various embodiments and not water-based in various other embodiments. In various embodiments, the chemical will change the properties of the base material (during a chemical dying process, for example) but will be made to leave the material during the subsequent drying process. In various other embodiments, the chemical will not change the properties of the base material (during a cleaning process, for example) but will nonetheless provide some benefit to the process—the removal of dirt in this example.

In various embodiments, the thickness of the coating 1330 will be at least 5 microns (0.005 mm) but in various embodiments the thickness will not be at least 5 microns and the disclosure of a coating 1330 having a thickness of at least 5 microns should not be considered limiting on the present disclosure. In various embodiments, the thickness of the coating 1330 will be in the range of 10 microns to 4,000 microns (0.010 mm to 4 mm), but in various embodiments the thickness will not be in the range of 10 microns to 4,000 microns and the disclosure of a coating 1330 having a thickness of 10 microns to 4,000 microns should not be considered limiting on the present disclosure.

During operation of acoustic drying system 100, material 1300 is placed on conveyor belt 160 inside a holder 1100 (shown in FIG. 11) after material 1300 has either received a coating 1330 and is still wet or, in the case of no coating, after material 1300 has become wet and is ready for drying. Holder 1100, to be discussed in more detail below, can be used to keep material 1300 from directly touching conveyor belt 160 and can also be used to hold material 1300 in tension. If a substantial portion of the material 1300—either substrate 1305 or coating 1330—touches the conveyor belt 160, damage to the coating 1330 or a reduction in the effectiveness of the drying process may result in various embodiments, but in other various embodiments is might be desirable for the material 1300 to contact the conveyor belt 160.

In various embodiments, it is beneficial to keep material 1300 in tension because a material 1300 in tension, especially a thinner material, will respond to the acoustic waves 250—ultrasonic waves, for example—differently than a material 1300 that is not in tension. A material 1300 in tension will tend to move itself as a result of the acoustic waves 250—ultrasonic waves, for example. As will be explained below, the degree of movement of the material 1300 and the degree of disruption of the boundary layer at the surface of the material 1300 will depend on a number of factors including the unsupported length of the material, the stretching or tensile force on the material 1300, and the mass per unit length of the material 1300. Specifically, the system is specifically designed in the current embodiment with idler rollers placed a certain distance apart to control the area of the section of film being dried acoustically, the surface tension of the film (S) being controlled by the tension between an unwind roller and a re-wind roller, and the mass density per unit area of the film (σ) being constant for a particular film.

In various embodiments of the indirect drying process, a tensile force is applied to the material 1300 in order to maintain the material 1300 in the aforementioned state of tension during the drying step. This can be especially beneficial when the drying equipment is positioned facing the side opposite the side of the material 1300 being dried. In some embodiments due to the thickness of the substrate or material 1300 or simply for simplicity, tension will be expressed as pounds of force per linear inch of web width, the tension being applied until the coating reaches a desired moisture content level. This desired moisture content level will vary depending on the application and will determine when the drying process is complete. The tension will in various embodiments be maintained in the range of 0.5 pounds per linear inch of web width to 4 pounds per linear inch of web width in order to effectively dry the coating 1330 or the material 1300 without the coating, though different amounts of tension are present in various other embodiments.

The relationship between the acoustic waves—including ultrasonic waves—and the material response can be represented by the following "dispersion relation":

$$\omega^2 = \frac{S}{\sigma} \cdot (k_x^2 + k_y^2)$$

Where omega ω is the time period of one fundamental oscillation (inversely proportional to the fundamental frequency), and $k_x$ and $k_y$ are constants that relate to the length of the film section and the width of the film section.

This equation is analogous to Mersenne's laws which state that the fundamental frequency of a length of string is as follows:

a) Inversely proportional to the length of the string
b) Proportional to the square root of the stretching force, and
c) Inversely proportional to the square root of the mass per unit length.

While not limited by theory, this disclosure includes tuning the film or material 1300 to resonate with the acoustic field, either at the fundamental frequency, or at a higher harmonic of the fundamental frequency. This will have the effect of disturbing the boundary layer at the surface by a greater degree and increasing the heat transfer rate and therefore also the drying rate.

Where a material 1300 includes both the substrate 1305 and wet coating 1330, the material 1300 is positioned so that the first side 1310 is facing the acoustic head 120 and the second side 1320 with coating 1330 is facing away from the acoustic head 120.

The next step involves moving the material 1300 in a transverse direction relative to the acoustic head 120 and an air delivery unit 265 (shown in FIG. 2), the acoustic head 120 including at least one ultrasonic transducer 1000, the ultrasonic transducer 1000 being part of the acoustic head 120, positioned facing the first side 1310 of the material 1300, the air delivery unit 265 also positioned facing the first side 1310 of the material 1300.

The final step involves drying the material 1300 using a combination of acoustic waves 250 (shown in FIG. 2) generated by the at least one ultrasonic transducer 1000 and airflow 1355 (shown in FIG. 2) directed towards the material 1300 by the air delivery unit 265. In the current embodiment, the separation distance D between the acoustic head 120 and the material 1300 is adjustable based on the separation distance D that maximizes the amplitude of the acoustic waves 250 as it hits that portion of the material 1300 being dried (as discussed above and shown in FIG. 3), though other considerations dictate the separation distance D in various other embodiments. As shown in FIG. 3, D1 and D2 represent two separate values for separation distance D that maximize the amplitude of the acoustic waves 250 in the current embodiment as the acoustic waves 250 hit material 1300 spaced at a separation distance of L1 or L2 away from the acoustic head 120, respectively.

In various embodiments of the system of FIG. 1, the following equipment and methods were used to apply, dry, and evaluate the properties of the coating 1330 either before or after coating or both before and after coating, though different equipment and methods are used in various other embodiments and the disclosure of the following equipment and methods should not be considered limiting:

Substrate: Aluminum cooking foil (clean) sized approximately 15×15 cm

Coating: TOYO PR-X0974 PROTECH WATER RESIST OPV FD weighing approximately 1 gram (Available from Toyo Ink America LLC, South Plainfield N.J.), where OPV is also referred to as an "over print varnish".

Oven: VULCAN ET4 Electric Half Size Convection Oven (Available from Vulcan-Hart Corp., 3600 N Point Blvd., Baltimore, Md. 21222)

Drying Duration: 20 minutes at 250° F.

Determination of % Solids: Based on the below formula:

$$\text{Solids}(\%) = \frac{\text{dried coating on foil} - \text{weight on foil}}{\text{wet coating on foil} \times \text{weight of foil}} \cdot 100\%.$$

Conveyor speed (also sometimes referred to as conveyor belt speed or belt speed): 25 feet per minute Conveyor Speed Measurement: CEN-TECH Digital Contact Tachometer (Item No. 66400, Available from distributor: Harbor Freight Tools, Camarillo, Calif.).

Coat Weight Determination: Coat-weights were measured by cutting a known surface area from the film by carefully following a 51 millimeter (mm) by 61 mm aluminum template (0.0033 $m^2$ surface area), and weighing it once dry. This was compared to the weight of a similarly cut uncoated film sample.

Wet coat weight was determined according to the following formula:

$$\text{Wet coat weight}(g/m^2) = \frac{\text{dried coating film} - \text{uncoated film}}{\text{surface area} \times \text{solids content}}.$$

Uncoated film weight was determined by cutting a sample of the film to the size described above and weighing it accurately to four decimal places using a chemical balance.

Film Weight Measurement: PRESICA 40SM-200A chemical top pan balance (Available from Presica Instruments AG, CH-Dietikon, Type 290-9842/K 40SM-200A, Max. 41 g/204 g, No. 11598).

Coated film dry weight was determined by cutting a sample of the coated film to the same size described above and weighing it accurately to four decimal places using a chemical balance.

Drying System and Set-Up: A 26" wide three-acoustic slot acoustic dryer system (HTI Spectra HE™ Ultra, available from Heat Technologies Inc., Atlanta Ga.) was mounted above a 24" wide conveyer belt so that the acoustic transducers are directed down toward and perpendicular to the mesh belt.

Conveyer and Conveyor Drive: Dayton Electric Manufacturing. Co., Chicago 60648, Model No. 4Z302B, Ref. No. 200647HD901; Ø5.5" drums, 24"(W)×90"(L) with below motor control).

Conveyor Speed Control: The conveyor speed was controlled by a variable drive (FINCOR, Incom International, Inc., 2350 DC Motor Control)

Air Blower: As well as the acoustic drying head, the acoustic dryer system also comprises a regenerative air blower Air Blower Speed Control: The speed of the air blower is controlled using a variable frequency drive (VFD) incorporated inside an HTI-built electrical control panel, an HTI-designed in-line 16 kW air heater with temperature control, controlled by a temperature controller and a thermocouple.

Ultrasonic Transducers: The ultrasonic transducers used in the HTI Spectra HE™ Ultra are documented in aforementioned US Patent Application 2010/0199501, which has already been incorporated by reference.

Other Components: Other components of the dryer system are documented in aforementioned US Patent Application 2010/0199501, which has already been incorporated by reference.

In various embodiments, a butt-roll of Skyrol® SH-76, 300 gauge, 0.050 mm (50 micron) thick polyethylene terephthalate (PET) film (available from SKC Inc., Covington Ga.) is cut into approximately 8 inches wide by 12 inches long, and fastened to a flat coating pad surface. Meyer rods are used to make draw-down coatings. Coated pieces of substrate are placed in a hinged holder 1100 and secured to the holder 1100 using 2-inch wide masking tape of the variety commonly available from painting supply and home improvement stores. The film is then stretched taught during the securing process so that it is tensioned into a substantially flat surface.

Disclosed in FIG. 2 is a schematic view of a second embodiment of an acoustic drying system 100' with the addition of a heater 280. Other than heater 280, acoustic drying system 100' is substantially similar to acoustic drying system 100. At the upper left, control panel 260 is connected to a electromechanical force ("EMF") identified as voltage source V. In various embodiments, this voltage and the current that results as a result of the electrical loads in circuit are supplied in the form of an alternating current ("AC") power source. In various other embodiments, voltage and current (and therefore power as expressed by Ohm's law, wherein power P is directly proportional to the product of voltage V and current I, expressed mathematically as P=VI) is supplied in direct current ("DC") form. Blower motor 270 and heater 280 receive power 295 from control panel 260. Blower motor 270 is connected to and rotates blower fan 275. Air from blower fan 275 is shown entering heater 280 at air temperature 291 and leaving at air temperature 292 before entering into acoustic head 120. While in some embodiments a forced airflow 1355 from the acoustic head 120 is not required or desired, the current embodiment shows the acoustic head 120 delivering airflow 1355 and acoustic waves 250 to the first side 1310 of material 1300. In the current embodiment, the second side 1320 of material 1300 with the coating or material surface to be dried is shown supported by and facing a register surface 161 of conveyor system 159 and facing away from the acoustic head 120. In this case, register surface 161 is defined by the surface of the conveyor belt 160 of material delivery unit 150 that is facing the acoustic head 120. Where used, the register surface 161 is that surface which supports material 1300 at the desired separation distance from the acoustic head 120.

Inputs to control panel 260 are pressure readings 285 at the outlet of the blower fan 275 and air temperature readings 290 at heater 280. Based on the material 1300 and/or coating 1330 being dried, the air pressure, air temperature 292, and the strength of acoustic waves 250 at the surface of the material 1300, or other characteristics of the system can be controlled at control panel 260. Blower motor 270, blower fan 275, heater 280, an inlet duct 266, and the delivery air inlet 130 of acoustic head 120 make up air delivery unit 265.

Disclosed in FIG. 3 is a side view of an embodiment of a dryer assembly 110 of the system of FIG. 1 including air delivery unit 265 and acoustic head 120. Blower motor 270, integral in the current embodiment with blower fan 275, pushes airflow 1351 through inlet duct 266 until it enters delivery air inlet 130 as airflow 1352. Acoustic waves 250 and airflow 1355 are shown exiting acoustic head 120 from air delivery enclosure 420 (shown in FIG. 4). After hitting the first side 1310 of material 1300, any air that does not mix with the ambient air surrounding the dryer assembly 110 is brought into the air return enclosure 410 of the acoustic head 120 and through return air outlet 145 and into outlet duct 267 as a result of a negative pressure inside outlet duct 267 or a pressure inside outlet duct 267 that is low enough to draw airflow 1356 into cavity between return air enclosure 410 and delivery air enclosure 420, where it becomes airflow 1357 and then becomes airflow 1358 upon entering outlet duct 267. As shown, the acoustic head 120 can be positioned to face only the first side of the material. Also as shown, the dryer assembly 110 is configured to dry the material without a second acoustic head being positioned adjacent to and facing the second side of the material opposite from the acoustic head. Superimposed on the dryer assembly 110 in FIG. 3 is a representation of acoustic waveform 255 with amplitude "A". As explained previously, the separation distance D between the acoustic head 120 and the material 1300 (see FIG. 2) is adjustable based on what will maximize the amplitude of the acoustic wave 250 as it hits that portion of the material 1300 being dried (as discussed above and shown in FIG. 3). Also as explained previously, D1 and D2 represent two separate values for D that maximize the amplitude "A" of the acoustic waves 250 as they hit material 1300 spaced at a distance of L1 or L2 away from the acoustic head 120, respectively. Material 1300 is shown at a separation distance L2 in the current embodiment.

Figure 4:
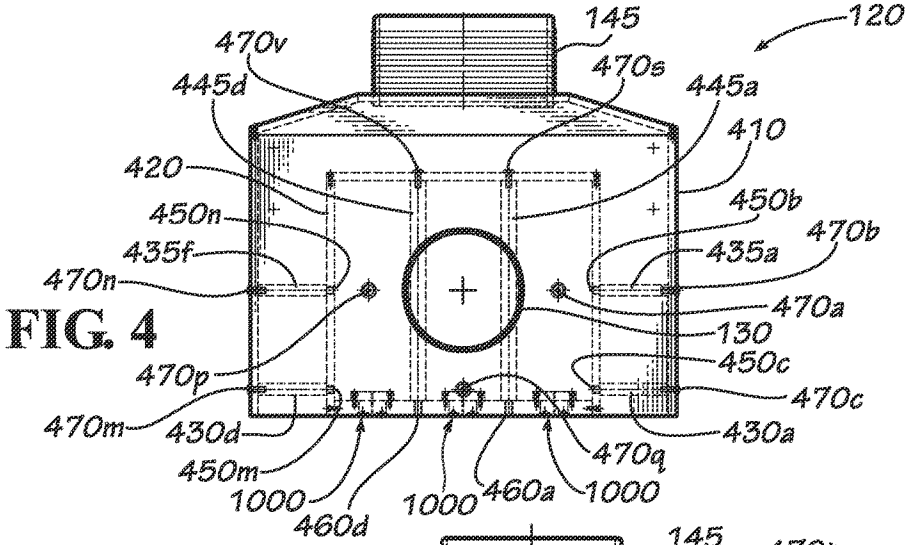
FIG. 4 is an end view of the dryer assembly of FIG. 3.

Disclosed in FIG. 4 is an end view of one embodiment of acoustic head 120 of dryer assembly 110. A delivery air inlet 130 extends through one end of air return enclosure 410, which defines the outermost shell of acoustic head 120. Delivery air inlet 130 is shown as having a round cross-section, however other shapes are considered part of this disclosure, including but not limited to square, rectangular, and polygonal cross-sections. On the top surface and attached to air return enclosure 410 is return air outlet 145. Shown in dotted lines in FIG. 4 is air delivery enclosure 420 supported inside air return enclosure 410 with lower side spacers 430*a-d* (430*b-c* shown in FIG. 6) and upper side spacers 435*a-f* (435*b-e* shown in FIG. 6). Also shown by hidden lines at the bottom of acoustic head 120 are three ultrasonic transducers 1000 and vertical spacers including vertical spacers 445*a,b,d* (445*b* shown in FIG. 5). A plurality of fasteners 450, 460, and 470 attach the lower side spacers 430*a-d*, upper side spacers 435*a-f*, and the vertical spacers including the vertical spacers 445*a,b,d* to the air delivery enclosure 420 and air return enclosure 410. Different numbers of ultrasonic transducers 1000, lower side spacers 430, upper side spacers 435, and vertical spacers 445, are present in various embodiments other than the numbers shown in FIG. 4.

Figure 5:
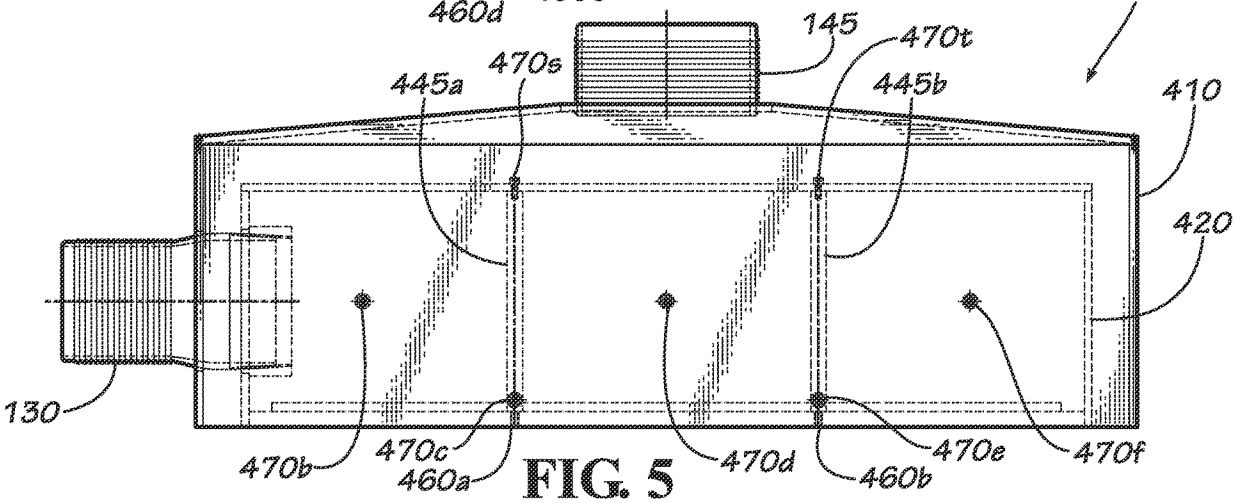
FIG. 5 is a side view of the dryer assembly of FIG. 3.

Disclosed in FIG. 5 is a side view of the same embodiment above of acoustic head 120 of dryer assembly 110. Shown is air delivery enclosure 420 (shown by hidden lines) nested inside air return enclosure 410. Supporting the bottom portion of air delivery enclosure 420 are the vertical spacers including the vertical spacers 445*a,b,d*. These spacers ensure that the bottom portion of air delivery enclosure 420 remains flat. Shown in hidden lines, this same bottom portion also includes three ultrasonic transducers 1000 and also upper side spacers 435*a,b,c*.

Figures 6, 7:
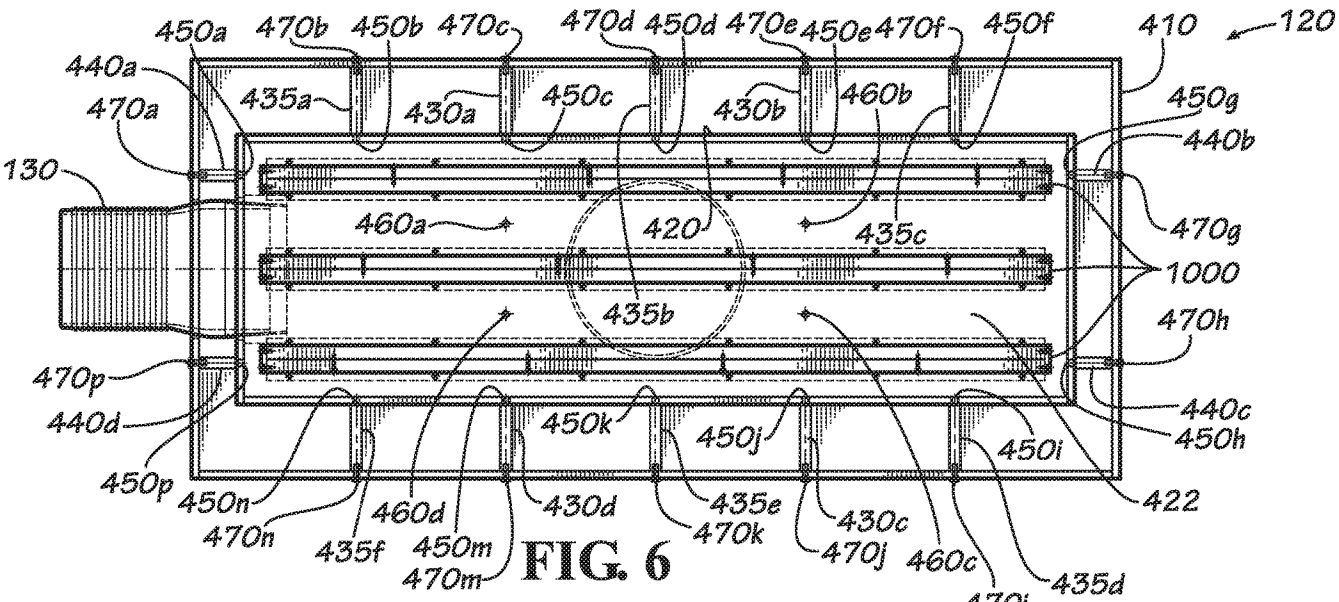
FIG. 6 is a bottom view of the dryer assembly of FIG. 3.
FIG. 7 is an end view of the acoustic head of the dryer assembly of FIG. 3.

Disclosed in FIG. 6 is a bottom view of the acoustic head 120 of dryer assembly 110.

Shown is air delivery enclosure 420 nested (and centered in this view) inside air return enclosure 410. Locating air delivery enclosure 420 inside air return enclosure 410 are the vertical spacers including the vertical spacers 445*a,b,d*, upper side spacers 435*a-f*, lower side spacers 430*a-d*, and end spacers 440*a-d*. Each of these spacers ensure that the air delivery enclosure 420 remains supported inside air return enclosure 410. Also shown are three ultrasonic transducers 1000. Each ultrasonic transducer is elongated and mounted in an acoustic slot defined in a bottom panel 422, each acoustic slot sized to provide clearance for acoustic waves 250 from the corresponding ultrasonic transducer. Both the air delivery enclosure 420 and the air return enclosure 410 of the acoustic head 120 are substantially rectangular in shape in the current embodiment, but in various other embodiments the air delivery enclosure 420 or the air return enclosure 410 of the acoustic head 120 or both are not substantially rectangular in shape and the disclosure of a substantially rectangular shape should not be considered limiting on the present disclosure.

Disclosed in FIG. 7 is an end view of the air delivery enclosure 420 of acoustic head 120 of dryer assembly 110. Delivery air inlet 130 extends into the air delivery enclosure 420. Holding the bottom panel 422 of air delivery enclosure 420 are vertical spacers 445*a,d* and end spacers 440*a,d*. Shown again in hidden lines, this same bottom portion also includes the three ultrasonic transducers 1000.

Figure 8:
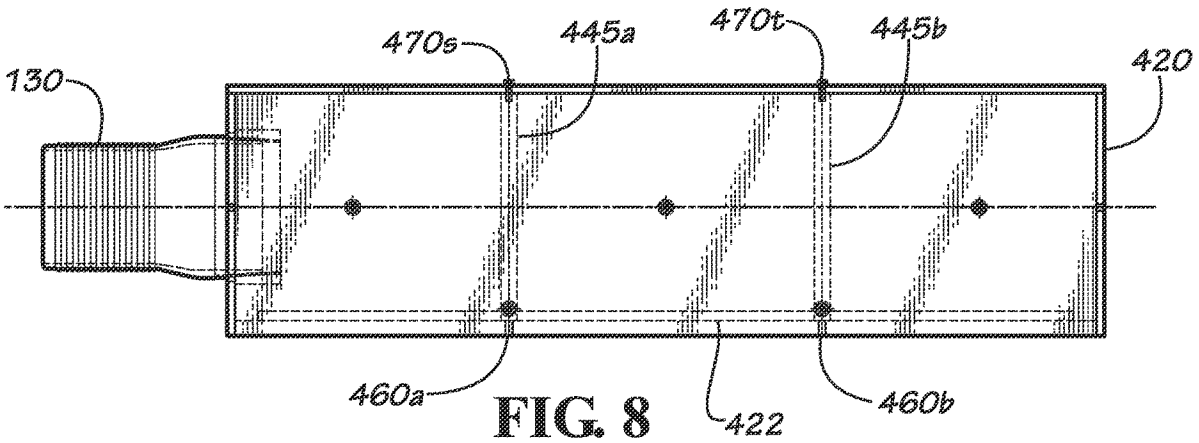
FIG. 8 is a side view of the acoustic head of the dryer assembly of FIG. 3.

Disclosed in FIG. 8 is a side view of the air delivery enclosure 420 of acoustic head 120 of dryer assembly 110. Attached to the left of air delivery enclosure 420 is delivery air inlet 130. Holding the bottom panel 422 of air delivery enclosure 420 are vertical spacers 445*a,b*.

Figure 9:
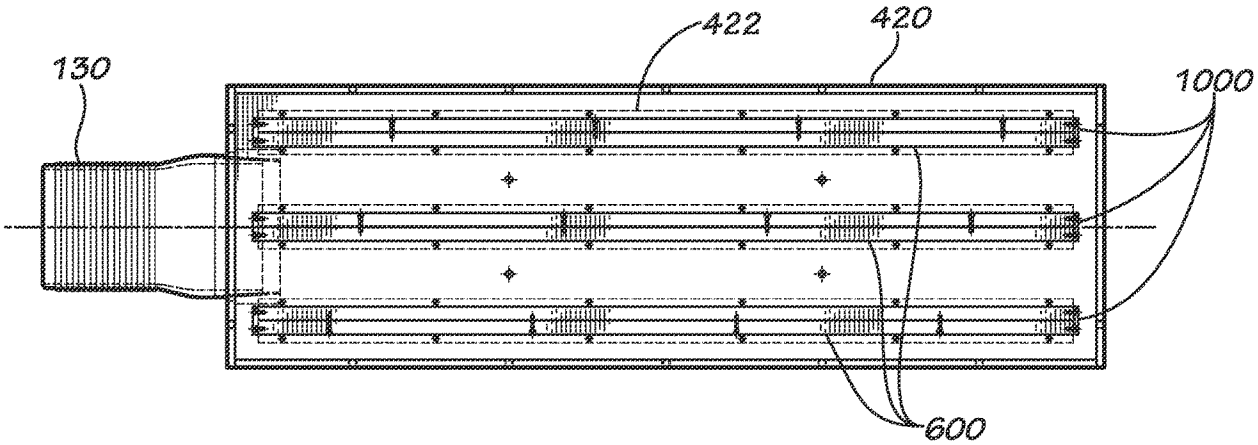
FIG. 9 is a bottom view of the acoustic head of the dryer assembly of FIG. 3.

Disclosed in FIG. 9 is a bottom view of the air delivery enclosure 420 of acoustic head 120 of dryer assembly 110. Shown again is the bottom panel 422 of air delivery enclosure 420 and the three ultrasonic transducers 1000.

Figure 10:
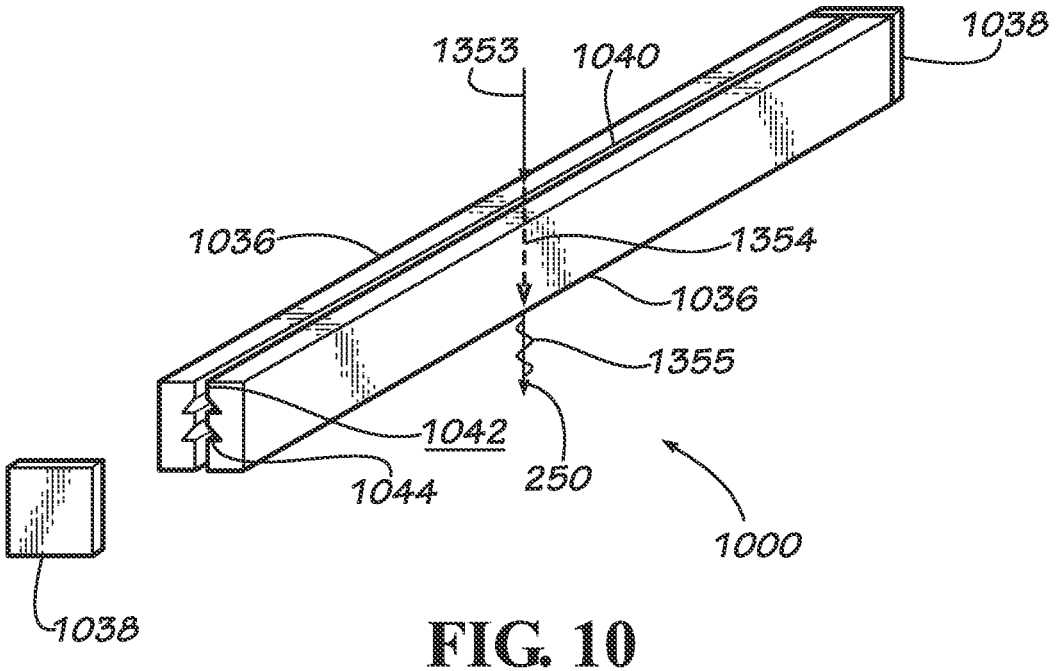
FIG. 10 is a perspective view of an ultrasonic transducer of the acoustic head of FIG. 7.

Disclosed in FIG. 10 is one embodiment of ultrasonic transducer 1000. This ultrasonic transducer 1000 is also shown in aforementioned U.S. Patent Publication No. 2010-0199510, published Dec. 12, 2010. Ultrasonic transducer 1000 includes two walls 1036 and two end caps 1038 that hold the walls 1036 in place spaced apart from each other to form a slot or air passage 1040. The ultrasonic transducer 1000 is elongated in the current embodiment, having a length between the end caps 1038 greater than the width of each end cap 1038. In various embodiments, the walls 1036 each define an inner surface 1042 with two grooves 1044 that extend the entire length of the walls 1036, with the grooves 1044 of one wall 1036 oppositely facing the grooves 1044 of the other wall 1036. When the airflow 1353 is forced through the air passage 1040, the grooves 1044 induce the acoustic waves 250 in the airflow 1354 that passes through and airflow 1355 that exits the ultrasonic transducer 1000. The depicted ultrasonic transducer 1000 is designed to be operable to cost-efficiently produce certain desired decibel levels, as described below. The acoustic waves 250 are ultrasonic in the current embodiment, but in various embodiments the acoustic waves 250 are not ultrasonic and the disclosure of ultrasonic waves should not be considered limiting on the present disclosure.

In various embodiments, the ultrasonic transducer 1000 has more or fewer grooves 1044, deeper or shallower grooves 1044, different shaped grooves 1044, grooves 1044 that do not extend the entire length of the walls 1036, a greater spacing between the grooves 1044 on the same wall 1036, or a greater spacing between the walls 1036. In other various embodiments, the ultrasonic transducer 1000 has a U-shaped air passage 1040 that induces the acoustic waves 250. And in still other various embodiments, the ultrasonic transducer 1000 is provided by another design of pneumatic transducer and/or by an electric-operated ultrasonic transducer.

In various embodiments, the ultrasonic transducer 1000 is operable to produce fixed frequency acoustic waves 250 in the ultrasonic sound pressure range of about 120 dB to about 190 dB at the interface surface of the material 1300 being treated, though other decibel ranges may be present in various embodiments. In various embodiments, the ultrasonic transducer 1000 is designed for producing acoustic waves 250 in the sound pressure range of about 130 dB to about 185 dB at the interface surface of the material 1300 being treated, more preferably about 160 dB to about 185 dB, and in other various embodiments about 170 dB to about 180 dB. These are the decibel levels at the interface surface of the material 1300, not necessarily the output decibel level range of the ultrasonic transducer 1000. In typical commercial embodiments, the ultrasonic transducer 1000 is selected to generate up to about 170 to about 190 dBs, though higher or lower dB transducers could be used.

Sound intensity (including the intensity of ultrasound) dissipates with the second power to the distance, so the closer the ultrasonic transducer 1000 is positioned to the material 1300, the lower in the dB range the dB level generated by the transducer can be. Many applications, by the nature of the process, require a transducer-to-material separation distance D of from about 4 mm to about 100 mm as stated previously, though other separation distances D are present in various embodiments. The larger the separation distance D, the higher the dB level that generally should be generated by the ultrasonic transducer in order to obtain the needed dB level at the interface surface of the material 1300. In addition, dB levels above the high end of the dB range could be used in some applications, but generally the larger transducers that would be needed are not as cost-effective and the sound level would be so high that humans could not safely or at least comfortably be present in the work area.

As shown in FIG. 3, the bottom of acoustic head 120 containing ultrasonic transducer 1000 is positioned with its outlet 1046 (from which the acoustic waves 250 are emitted) spaced from the interface surface of the material 1300 to be dried by a separation distance D. The separation distance D is about $(\lambda)(n/4)$, where "$\lambda$" is the wavelength of the acoustic waves 250 and "n" is preferably an odd integer (1, 3, 5, 7, etc.). In this way, when the acoustic waves 250 reach the interface surface of the material 1300, they are at about maximum amplitude A, which maximizes the disruption of the boundary layer and results in increased water/solvent evaporation rates. For relatively lower frequency oscillations or waves, the separation distance D is preferably such that "n" is either 1 or 3, and most preferably such that "n" is 1, so that the separation distance D is minimized. For relatively higher frequency oscillations or waves, "n" can be a larger odd integer. In various embodiments, the separation distance D is such that "n" is in the range of plus (+) or minus (−) 0.5 of an odd integer (0.5 to 1.5, 2.5 to 3.5, 4.5 to 5.5, 6.5 to 7.5, etc.). In other words, the oscillations or waves are in the ranges of 45 to 135 degrees, 225 to 315 degrees, etc. In other various embodiments, the separation distance D is such that "n" is in the range of plus (+) or minus (−) 0.25 of an odd integer (i.e., 0.75 to 1.25, 2.75 to 3.25, 4.75 to 5.25, 6.75 to 7.25, etc.). In other words, the oscillations or waves are in the ranges of 67.5 to 157.5 degrees, 247.5 to 337.5 degrees, etc. In this way, when the acoustic waves 250 reach the interface surface of the material 1300, even though they are not at maximum amplitude A of acoustic waveform 255, they are still close enough to it (and within the workable and/or preferred decibel ranges) for acceptable boundary layer disruption.

In order for the ultrasonic transducer 1000 to be spaced from the material 1300 in this way, the acoustic head 120 can be provided with a register surface 161 for fixing the separation distance D. In various embodiments, the register surface 161 can be provided by a flat sheet and the material 1300 can be conveyed across it on a conveyor belt 160 driven by drive rollers before and after the sheet. In various other embodiments, the register surface 161 can be provided by one or more rollers that support material 1300 directly, by a conveyor belt 160 supporting the material 1300, or by another surface known to those skilled in the art. In any event, the register surface 161 is spaced the separation distance D from the ultrasonic transducer 1000 (or positioned slightly more than the separation distance D from the ultrasonic transducer to account for the thickness of the material 1300 and the conveyor belt 160). Embodiments without a register surface 161 are often used when the material 1300 is web-based, otherwise self-supporting, or tensioned by conventional tensioning mechanisms. In various embodiments, the material 1300 will be stretched across a register surface 161 in the same way that the material 1300 inside holder 1100 holds the material 1300 in tension. In various other embodiments, the tensioning mechanism will include idler pulleys which maintain tension in a material 1300' (shown in FIG. 12 and fed from an unwinding roll 1210) during the drying process or will include control of the rotation and speed of an unwinding roll 1210 (shown in FIG. 12) and the rotation and speed of a rewinding roll 1230 (shown in FIG. 12) or by controlling a combination of these and other factors. In various embodiments wherein a register surface 161 is not used, the tensioning mechanism will include idler pulleys, which maintain tension in the material 1300 during the drying process or will include control of the rotation and speed of unwinding roll 1210 and of the rewinding roll 1230 or by controlling a combination of these and other factors.

As stated previously, the acoustic head 120 can be provided with the aforementioned support and positioning mechanism 220 for maintaining or adjusting the separation distance D between the ultrasonic transducer 1000 and the material 1300. The support and positioning mechanism 220 may be provided by conventional devices including but not limited to rack and pinion gearing, screw gearing, or mechanical fasteners. The support and positioning mechanism 220 may be designed to move the air delivery enclosure 420, air return enclosure 410, and one or more ultrasonic transducers 1000 of acoustic head 120 closer to or further away from material 1300 by moving the acoustic head 120 or by moving the material 1300 or by moving both the acoustic head 120 and the material 1300.

In order to consistently produce the precise decibel levels at the interface surface of the material 1300, a method of manufacturing and/or installing the acoustic head 120 is provided. The method includes calibrating the acoustic head 120 for the desired decibel levels. First, the separation distance D is calculated based on the frequency of the selected ultrasonic transducer 1000. For example, an ultrasonic transducer 1000 with an operating frequency of 33,000 Hz has a wavelength of about 0.33 inches at a fixed temperature, so acceptable separation distances D include (0.33) (¾) equals 0.25 inches and (0.33) (5/4) equals 0.41 inches, based on the formula D equals (λ)(n/4). Similarly, an ultrasonic transducer 1000 with an operating frequency of 33 kHz has a wavelength of about 0.41 inches, so acceptable separation distances D include (0.41) (¾) equals 0.31 inches and (0.41) (5/4) equals 0.51 inches.

Then the ultrasonic transducer 1000 is positioned at the calculated separation distance D from the first side 1310 of material 1300 (or from the conveyor belt 160 that will carry the material 1300, or from the register surface 161). Next, a sound input device (e.g., a microphone, not shown) is placed at the material 1300 (or at the conveyor belt 160 that will carry the material 1300, or at the register surface 161, or at the separation distance D from the ultrasonic transducer 1000). The sound input device is connected to a signal conditioner (not shown). The sound input device and the signal conditioner are used to measure the air pressure wave (i.e., the acoustic waves 250) in psig and convert that to decibels (dB). For one example among others, at a temperature of 120° F. and a flow rate of 35 ft/sec, a sound wave measured at 5 psig converts to 185 dB. Suitable microphones and signal conditioners are commercially available from Endevco Corporation (San Juan Capistrano, Calif.) and from Bruel & Kjer (Switzerland).

Once this baseline decibel level has been determined, the acoustic head 120 can be adjusted for maximum effectiveness. For one example among others, the support and positioning mechanism 220 can be adjusted to alter the preset separation distance D to see if the decibel level increases or decreases at the altered separation distance D. If it decreases, then the preset separation distance D was accurate to produce the maximum amplitude A, and this separation distance is used. But if it increases, then the altered separation distance D is used as the new baseline and the separation distance D is adjusted again. This fine-tuning process is repeated until the maximum amplitude A within the design range is found. The adjustment of separation distance D by support and positioning mechanism 220 can be made by direct manipulation of support and positioning mechanism 220 or it can be made by automatic electronic control based on one or more various inputs including but not limited to the conveyer speed, the type of coating system, the coating rod diameter in the case of a rod coating system, substrate specification, substrate thickness, coating specification, coating thickness, acoustic wave strength, air pressure, air speed, and air temperature.

In addition, because the depicted embodiment includes a pneumatic-type ultrasonic transducer 1000, it is operable to produce the desired decibel levels by adjusting the flow-rate of the inlet airflow 1350. So if the baseline decibel level is not in the desired range, then the inlet airflow 1350 rate can be adjusted (e.g., by increasing the speed of the fan or blower) until the decibel level of airflow 1355 is in the desired range. The same procedure can be applied to electrically-powered ultrasonic transducers. Similar adjustments can be made with a signal amplifier, when electrically-based ultrasonic transducers are used.

Figure 11:
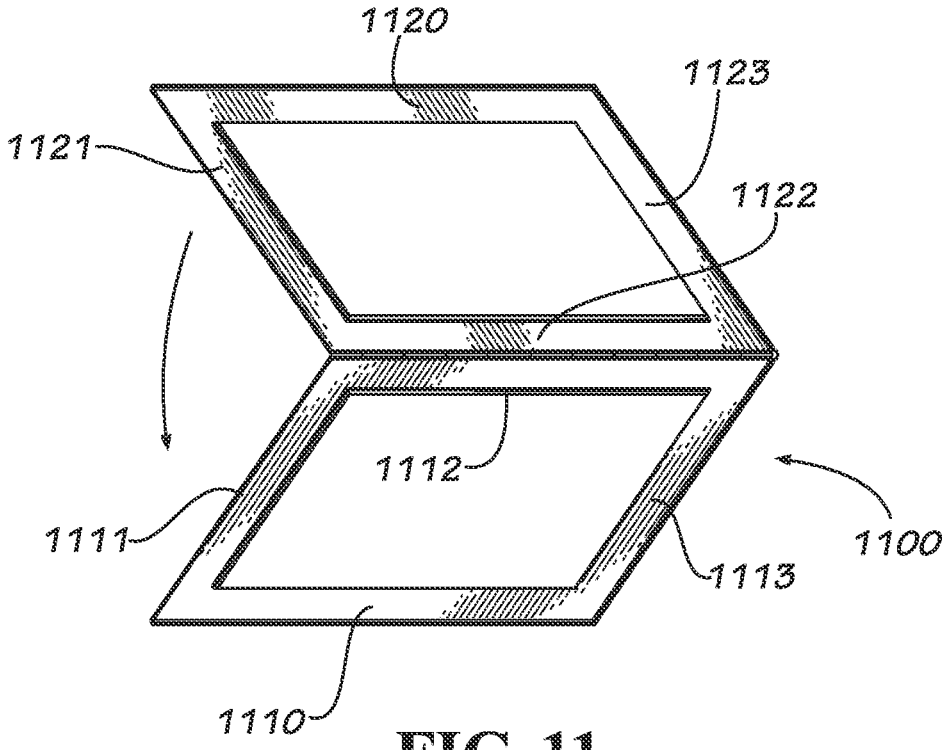
FIG. 11 is a perspective view of a holder frame of the system of FIG. 1.

Disclosed in FIG. 11 is holder 1100 used for holding material 1300 as part of acoustic drying system 100. The top half of holder 1100 includes upper front frame 1120, upper left frame 1121, upper right frame 1123, and upper rear frame 1122, which together define an opening in the center. The bottom half of holder 1100 includes lower front frame 1110, lower left frame 1111, lower rear frame 1112, and lower right frame 1113, which together also define an opening in the center. The top and bottom halves of holder 1100 may be joined by a hinge as shown or may be joined with any number of other fasteners, including but not limited to tape, screws, and clips. In the embodiment utilizing such a holder 1100 (acoustic drying system 100, for example), the material 1300 is held in tension, the importance of which has been described earlier in the disclosure, by securing each side of the material 1300 to the upper and lower halves of holder 1100 with tape or with one or more other fasteners, including but not limited clips, snaps, screws and magnets. In various embodiments, this will result in material 1300 being exposed where the opening is defined in the top hold of holder 1100 and in the bottom half of holder 1100. Holder 1100 is used in various embodiments to dry samples or small portions of material 1300 where it is not desirable to coat and dry a roll of material 1300.

Figure 12:
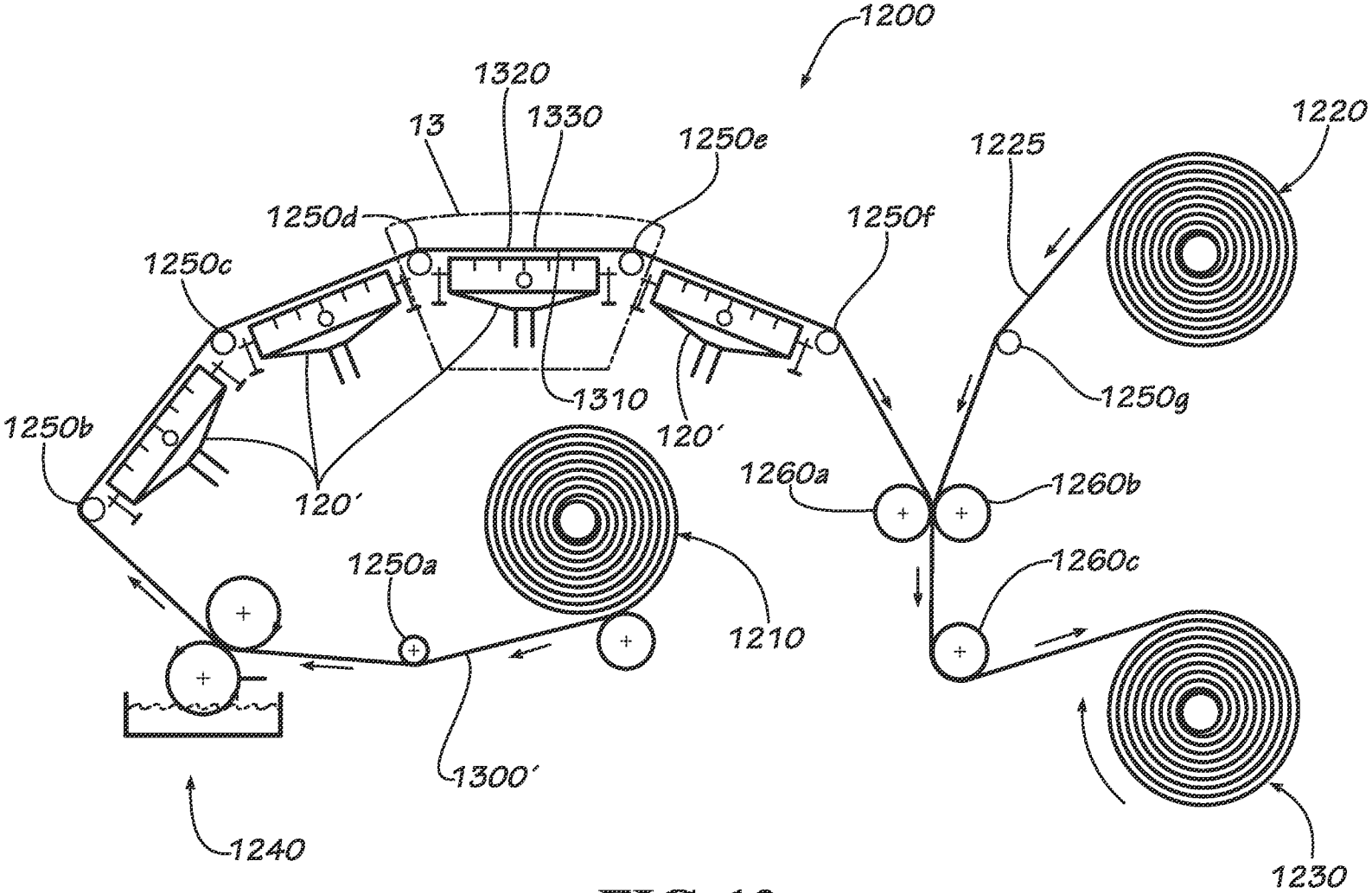
FIG. 12 is a side view of one embodiment of a system for coating and drying a material.

Disclosed in FIG. 12 is a second embodiment of an acoustic drying system 1200. Upon exiting unwinding roll 1210, material 1300' is coated via a coating system 1240. Coating system 1240 may include any one of a number of roll-to-roll coating processes making use of a gravure coater, a slot-die coater, a roller coater, a curtain coater, a bead coater, or a Mayer coating rod. Based on a paper by Herbert B. Kohler of The Kohler Coating Machinery Corporation titled "Modern Rod Coaters", a typical Mayer rod coating process, initially developed by Charles W. Mayer in the early 1900's, applies a uniform coating to a substrate or "web" as follows:

1. A round coater rod applies excess of a coating material (as much as 3 to 10 times a desired final coat weight) to a web with an applicator roll driven by an adjustably variable speed drive that picks up the coating material from an application pan situated below the applicator roll.
2. A set of edge wipers or "deckles" on the applicator roll wipe excess coating material from the web surface at the edges of the web.
3. The web, maintained in tension, is made to pass over a wire-wound rod, whose wire size determines the final coat weight. and which is usually independently driven counter to the direction of web movement.
4. The groove between the wires of the wire-wound rod allow a predetermined amount of coating material to remain on the web, while the excess coating material is caused to fall into a collection pan, where the excess coating material is normally de-aerated and strained to remove contaminants before being returned to the application pan.
5. The surface tension of the coating material causes the coating material to spread out uniformly across the web surface to form a coating ahead of drying.

These steps will vary slightly or may not be present in various embodiments depending on the equipment being used and depending on the application. There may be additional steps added to the process. For other coating methods, the steps taken may be completely different. In addition to the roll-to-roll coating processes listed above, other coating processes will be used in various embodiments including but not limited to vapor deposition, conversion coating, plating, spraying, and roll-to-roll coating methods other than those already mentioned.

What is sometimes important in the selection of a coating method and coating thickness is the selection of a coating method that will apply the desired coating thickness in such a way that it will meet the aesthetic and functional requirements of that coating 1330. Aesthetic requirements may dictate that one or more colors, one or more patterns, text or any number of finishes—including but not limited to those finishes described as gloss, satin, or matte—be applied consistently to the substrate 1305 across large numbers of product and across multiple production runs spread out over time. Functional requirements may dictate that the coating 1330 or a material 1300 without the coating 1330 that is nonetheless being dried be able to consistently exhibit certain adhesion, wetability, corrosion resistance, wear resistance, electrical conductivity, electrical insulation, or other physical properties after the coating has dried sufficiently.

In various embodiments, material 1300' is transported and kept taught across idler rollers 1250*a-f*. Between idler rollers 1250*b-f*, a series of four acoustic heads 120' successively dry the material 1300', now with coating 1330', until the point at which material 1300' is caused to join a release paper 1225 from a release paper roll 1220. Rewinding roll 1230 pulls lengths of material 1300' from unwinding roll 1210 and release paper roll 1220 through rolls 1260*a-c*. In various embodiments, the release paper 1225 is omitted or may be made out of some material other than release paper 1225 that will achieve a similar purpose or have a similar structure as release paper 1225. Idler roller 1250*g* helps provide tension on release paper 1225 before release paper 1225 is combined with material 1300'.

Figure 13:
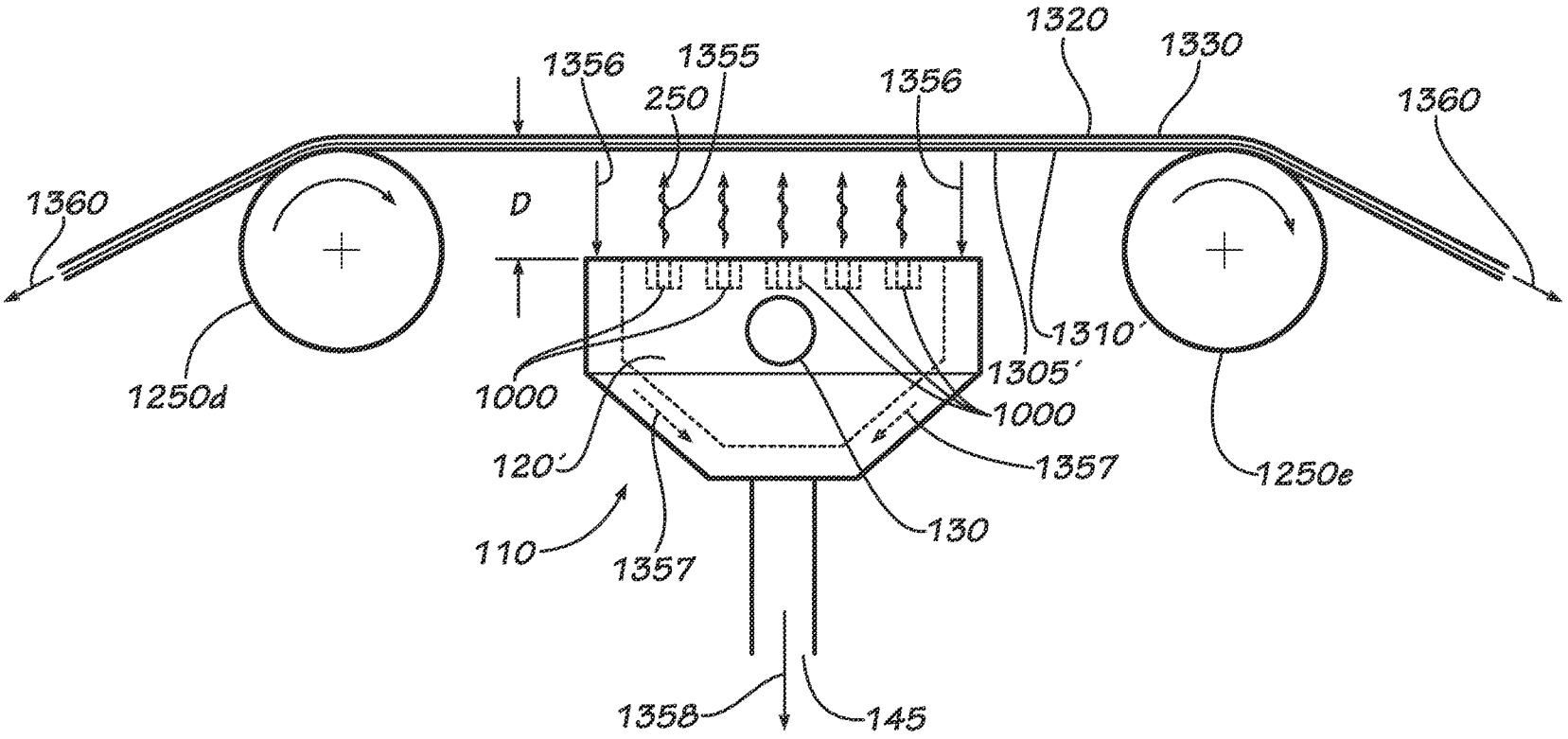
FIG. 13 is a detail view of a dryer system of the system of FIG. 12 identified by detail 13 in FIG. 12.

Disclosed in FIG. 13 is a detail view of acoustic head 120' in acoustic drying system 1200. Acoustic head 120' is shown facing first side 1310' of material 1300'. Coating 1330', the portion to be dried, is facing in the opposite direction, thereby in a position to be indirectly dried by acoustic head 120'.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A method of opposite-side drying and curing of a coating on a material, the method comprising:

applying a water-based coating to be dried to a substrate to form a material, wherein the substrate defines a first side and a second side opposite from the first side, wherein the substrate comprises a continuous web, wherein the material defines a first side and a second side opposite the first side, wherein the first side of the substrate defines the first side of the material, wherein the coating to be dried at least partially covers the second side of the substrate, wherein the coating and any exposed portion of the second side of the substrate together define the second side of the material, wherein the coating comprises solids and a liquid bulk;

providing an acoustic head, wherein the acoustic head is positioned facing only the first side of the material, wherein the acoustic head comprises an ultrasonic transducer facing only the first side of the material, wherein the ultrasonic transducer comprises two walls, wherein each of the two walls defines an inner surface and a groove defined in the inner surface, wherein the inner surface of a first wall of the two walls is spaced apart from and faces the inner surface of a second wall of the two walls, wherein an air passage is formed between the inner surfaces of the two walls, and wherein an exit of the ultrasonic transducer is offset from the first side of the material by a separation distance;

moving the material in a transverse direction relative to the acoustic head;

forcing airflow through the air passage of the ultrasonic transducer;

inducing acoustic waves in an ultrasonic range with the grooves of the inner surfaces of the two walls of the ultrasonic transducer; and drying the coating using the acoustic waves such that the liquid bulk of the coating evaporates and the solids of the coating remain on and adhere to the substrate after drying the coating, wherein drying the coating using the acoustic waves comprises directing the acoustic waves at only the first side of the material, and wherein no second acoustic head is positioned adjacent to and facing the second side of the material opposite from the acoustic head.

2. The method of claim 1, further comprising applying a tensile force to the material in order to maintain the material in tension during drying, wherein the material has a web width, wherein the tension is applied until the coating reaches a desired moisture content level, wherein the tension is in a range of 0.5 pounds per linear inch of web width to 4 pounds per linear inch of web width.

3. The method of claim 1, wherein directing the acoustic waves at only the first side of the material comprises directing acoustic waves in a direction perpendicular to the first side of the material.

4. The method of claim 1, further comprising adjusting the separation distance to equal (λ)(n/4), wherein "λ" is a wavelength of the acoustic oscillations and "n" is in a range of plus or minus 0.5 of an odd integer so that the acoustic oscillations at the interface surface of the material are centered at about a maximum amplitude of the acoustic oscillations.

5. A system for opposite-side drying of a coating on a material, the system comprising:

the material, wherein the material comprises a substrate and a water-based coating applied to the substrate, wherein the substrate defines a first side and a second side opposite from the first side, wherein the first side of the substrate defines a first side of the material, wherein the coating is applied to and completely covers the second side of the substrate, wherein the coating defines a second side of the material, wherein the second side of the material faces an opposite direction from the first side of the material, and wherein the coating comprises solids that are configured to remain on and adhere to the substrate after drying of the coating; and an acoustic head comprising:

an air delivery enclosure positioned adjacent to and facing only the first side of the material; and an ultrasonic transducer positioned inside a portion of the air delivery enclosure nearest the material, wherein an exit of the ultrasonic transducer faces only the first side of the material, wherein the exit of the ultrasonic transducer is offset from the first side of the material by a separation distance, wherein the ultrasonic transducer is configured to produce acoustic waves in an ultrasonic range, and wherein both the air delivery enclosure and the ultrasonic transducer are configured to dry the coating with the acoustic waves when the acoustic waves are directed at only the first side of the material and when the coating to be dried is only on the second side of the material; and wherein no second acoustic head is positioned adjacent to and facing the second side of the material opposite from the acoustic head.

6. The system of claim 5, wherein the acoustic head defines an acoustic slot.

7. The system of claim 6, further comprising a plurality of rollers configured to be in contact with the material and configured to move the material with respect to the acoustic head while maintaining the separation distance.

8. The system of claim 5, wherein the air delivery enclosure is configured to deliver air through the ultrasonic transducer.

9. The system of claim 5, wherein the material defines a length, width, and thickness, wherein the system further comprises a holder configured to secure the material, wherein the system is configured to dry the material when the material is secured and maintained under tension inside the holder.

10. The system of claim 5, wherein the acoustic head further comprises an air return enclosure, wherein the air delivery enclosure is supported inside the air return enclosure with a plurality of spacers extending from the air return enclosure to the air delivery enclosure, wherein each of the plurality of spacers is secured to each of the air return enclosure and the air delivery enclosure with a fastener; wherein each of a bottommost portion of the air return enclosure, a bottommost portion of the air delivery enclosure, and the exit of the ultrasonic transducer defines a flush bottom of the acoustic head.

11. The system of claim 10, wherein the air delivery enclosure and the air return enclosure each comprise five adjoining walls, wherein each wall of the five adjoining walls of the air delivery enclosure faces a corresponding wall of the five adjoining walls of the air return enclosure, wherein each wall of the five adjoining walls of the air delivery enclosure and the corresponding wall of the five adjoining walls of the air return enclosure define a cavity therebetween.

12. The system of claim 5, wherein the separation distance is equal to (λ)(n/4), wherein "λ" is a wavelength of the acoustic oscillations and "n" is in a range of plus or minus 0.5 of an odd integer so that the acoustic oscillations at the interface surface of the material are centered at about a maximum amplitude of the acoustic oscillations.

13. A system for indirectly drying a coating, the system comprising:

a material comprising a substrate and a water-based coating applied to the substrate, wherein the substrate defines a first side and a second side opposite from the first side, wherein the substrate comprises a continuous web, wherein the first side of the substrate defines a first side of the material, wherein the coating is applied to the second side of the substrate, wherein the coating and an exposed portion of the second side of the substrate together define a second side of the material, wherein the second side of the material faces an opposite direction from the first side of the material, and wherein the coating comprises solids configured to remain on and adhere to the substrate after drying of the coating;

an acoustic head, wherein the acoustic head comprises an ultrasonic transducer facing only the first side of the material, wherein an exit of the ultrasonic transducer is offset from the first side of the material by a separation distance, wherein the ultrasonic transducer is configured to produce acoustic waves in an ultrasonic range;

wherein the acoustic head further comprises an air delivery enclosure, wherein the air delivery enclosure is also positioned facing only the first side of the material, and wherein both the air delivery enclosure and the ultrasonic transducer are configured to dry the coating with the acoustic waves when the acoustic waves are directed at only the first side of the material and when the coating to be dried is only on the second side of the material; and wherein no second acoustic head is positioned adjacent to and facing the second side of the material opposite from the acoustic head.

14. The system of claim 13, wherein the substrate is a continuous film having a thickness in the range of 10 microns to 2,000 microns and having a constant mass density per unit area.

15. The system of claim 13, wherein the substrate comprises a foil material or a polymer film.

16. The system of claim 13, wherein the coating has a thickness of at least 5 microns.

17. The system of claim 16, wherein the coating has a thickness in the range of 10 microns to 4,000 microns.

18. The system of claim 13, wherein the separation distance is between 4 mm and 100 min.

19. The system of claim 13, further comprising a material delivery unit, wherein the material delivery unit includes a plurality of rollers adapted to transport the material past the acoustic head, and wherein the plurality of rollers hold the material relative to the acoustic head by the separation distance.

20. The system of claim 19, wherein the plurality of rollers is configured to maintain the substrate in tension at a portion of the material to be dried.

21. The system of claim 19, wherein the separation distance is adjustable.

22. The system of claim 21, wherein the separation distance is adjustable by automatic electronic control based on inputs defining a conveyer speed, a type of coating system, a substrate specification, a substrate thickness, a coating specification, a coating thickness, an acoustic wave strength, an air pressure, an air speed, or an air temperature.

23. The system of claim 13, further comprising a coating system adapted to apply the coating on the substrate.

24. The system of claim 13, further comprising a coating system adapted to apply the coating on the substrate, wherein the coating system includes a gravure coater, a slot-die coater, a roller coater, a curtain coater, a bead coater, or a Mayer coating rod.

25. The system of claim 13, further comprising a blower fan, wherein the blower fan delivers ambient air via the acoustic head to the first side of the material.

26. The system of claim 13, wherein the separation distance is equal to $(\lambda)(n/4)$, wherein "$\lambda$" is a wavelength of the acoustic oscillations and "n" is in a range of plus or minus 0.5 of an odd integer so that the acoustic oscillations at the interface surface of the material are centered at about a maximum amplitude of the acoustic oscillations.

* * * * *